US006606833B2

(12) United States Patent
Richardson et al.

(10) Patent No.: US 6,606,833 B2
(45) **Date of Patent: *Aug. 19, 2003**

(54) APPARATUS AND METHODS OF FORMING A DISPLAY CASE DOOR AND FRAME

(75) Inventors: Richard J. Richardson, Simi Valley, CA (US); Timothy Carson, Thousand Oaks, CA (US); Raymundo Calderon, Sylmar, CA (US); Jeffery Nicholson, Palmdale, CA (US); John Nazarian, North Hollywood, CA (US); Charles E. Crown, San Fernando, CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/877,735

(22) Filed: Jun. 9, 2001

(65) Prior Publication Data

US 2002/0078654 A1 Jun. 27, 2002

Related U.S. Application Data

(63) Continuation-in-part of application No. 09/591,138, filed on Jun. 9, 2000.

(51) Int. Cl.[7] ..... E06B 3/00

(52) U.S. Cl. ..... 52/204.5; 52/204.1; 52/656.9; 312/116; 312/138.1; 49/504

(58) Field of Search ..... 52/656.9, 204.1, 52/204.5, 784.1; 312/116, 138.1; 49/504

(56) References Cited

U.S. PATENT DOCUMENTS

| | | | | |
|---|---|---|---|---|
| 2,834,999 A | | 5/1958 | Taylor et al. | |
| 4,741,127 A | | 5/1988 | Bockwinkel | |
| 4,753,043 A | | 6/1988 | Bockwinkel | |
| 4,852,303 A | | 8/1989 | Rolek | |
| 4,941,289 A | | 7/1990 | Rolek | |
| 4,998,382 A | | 3/1991 | Kostos et al. | |
| 5,024,023 A | | 6/1991 | Kostos et al. | |
| 5,035,085 A | | 7/1991 | Mamelson et al. | |
| 5,111,618 A | | 5/1992 | Kaspar et al. | |
| 5,255,473 A | | 10/1993 | Kaspar et al. | |
| 5,460,862 A | | 10/1995 | Roller | |
| 5,644,894 A | * | 7/1997 | Hudson | 52/786.1 |
| 5,683,764 A | | 11/1997 | Alts | |
| 5,910,083 A | * | 6/1999 | Richardson et al. | 312/138.1 |
| 6,029,411 A | | 2/2000 | Richardson | |
| 6,122,869 A | | 9/2000 | Richardson | |
| 6,298,615 B1 | | 10/2001 | Richardson | |
| 6,367,223 B1 | * | 4/2002 | Richardson et al. | 52/659.9 |
| 2002/0073645 A1 | | 6/2002 | Richardson | |
| 2002/0078654 A1 | | 6/2002 | Richardson | |

FOREIGN PATENT DOCUMENTS

WO WO01/93727 A2 12/2001

* cited by examiner

*Primary Examiner*—Carl D. Friedman
*Assistant Examiner*—Nahid Amiri
(74) *Attorney, Agent, or Firm*—Henricks, Slavin & Holmes

(57) ABSTRACT

Perimeter frame rails and door frames rails are described for a more thermally efficient and cost-effective display case such as for refrigerated display cases. The frames are preferably formed from cold rolled steel. A perimeter frame may include first, second and third walls defining an opening or a recess that can be closed by a contact plate. A door for a refrigerated display case may include a glass unit and a forward portion extending inwardly from a perimeter frame edge portion toward an edge of the forward glass pane and a first side portion extends rearwardly to a groove. An insulating member insulates the door rail from the cold area and includes a portion engaging the groove. A glass door is also provided for a refrigerated display case having a first glass panel, a second glass panel, and low emissivity coatings on the inside surfaces of the first and second glass panels. One or more intermediate glass panels can also be included. Spacer assemblies are used to separate adjacent glass panels and preferably include a desiccant-embedded sealant. Preferably, little or no metal structures are used in the spacers.

50 Claims, 13 Drawing Sheets

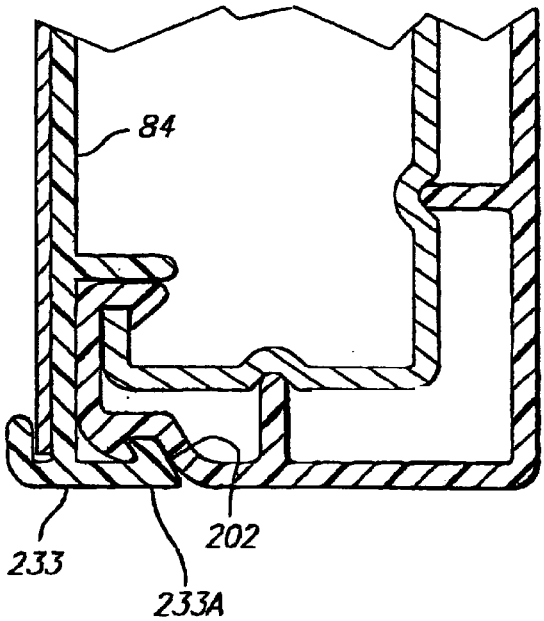
FIG. 19
FIG. 20
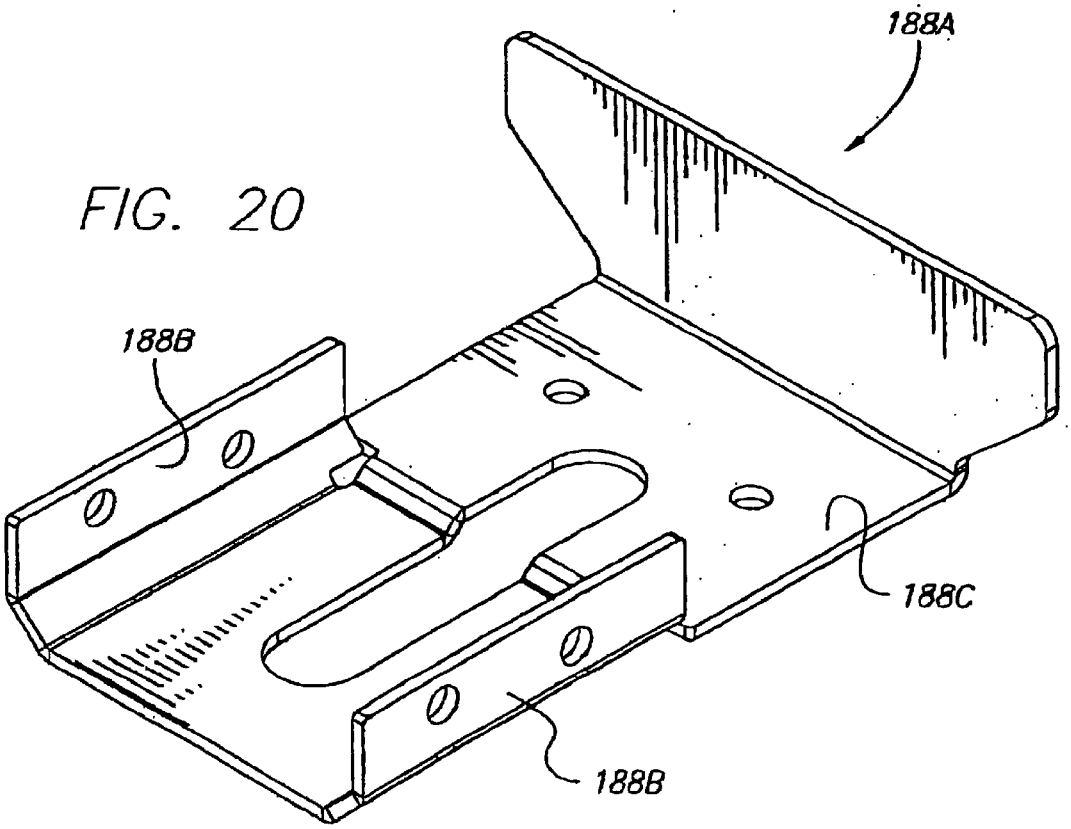

APPARATUS AND METHODS OF FORMING A DISPLAY CASE DOOR AND FRAME

CROSS REFERENCE TO RELATED APPLICATIONS

This application is a continuation-in-part of Ser. No. 09/591,138 filed Jun. 9, 2000, incorporated herein by reference.

BACKGROUND OF THE INVENTIONS

1. Field of the Invention

These inventions relate to perimeter and frame rail elements, doors and assemblies for display cases.

2. Related Art

Commercial refrigerators and refrigerated display cases (coolers and freezers) are used in markets, food-vending operations, liquor stores and the like for the preservation of freshness and attractive display of product to the customer. Typically, commercial display cases have extruded aluminum frames defining a rectangular opening for the case which is accessed through sliding doors or swing doors having large areas of multi-layered glazing to permit the customer to see, select and access the refrigerated product easily, while preventing heat transfer into the refrigerated space. The raw aluminum is expensive and the extrusion process also adds significant costs to the final product. After extrusion, the linear segments of rail are cut to the desired length and shape (such as to have mitered corners), punched to give holes for mounting and fastening various hardware to the frame rail, and finished to remove rough edges and the like. Four frame rail elements are used for small to medium-sized cases while more may be used for larger cases. The frame rails are fastened together at mitered corners of upper and lower horizontal frame members and left and right vertical side members, sometimes referred to as end mullions. The surrounding frame rails typically have a decorator strip, extending over the front of the case, a side-wall extending inwardly relative to the case from the decorator strip, the side-walls of the top and bottom rails supporting the hinges for the doors, and a transverse wall for mounting a contact plate against which the magnetic gasket on the door seals. The transverse wall also forms a support for center mullions in the display case. The center mullions extend vertically between upper and lower frame rails to give a sealing surface for the doors and contain wiring, ballasts or other hardware for operating lighting units mounted on the surfaces of the mullion extending into the display case. The rearwardly facing portions of the transverse walls also may support raceways or other hardware for equipment used in the unit.

The hardware for connecting the corners of the frame rail structures, and for connecting the mullions and the frame rail elements, can be complicated, with a significant number of inter-fitting parts to provide a suitable corner connection. Additionally, the processing of the frame rail elements that permits hardware such as hinges and hold opens to be mounted to the frame uses multiple steps and adds to the cost of the final product.

Typically, an extruded aluminum door rail supports and surrounds the multi-layered glazing to support the glazing panels and to protect the edges thereof. Such door rails hold the glass panels in place and extend peripherally around both the inside and outside glass surfaces of the doors. The door rails are fastened together at mitered corners of upper and lower horizontal rail members and left and right vertical side members. The hardware for connecting the corners of the rail structures also can be complicated, with their own significant number of inter-fitting parts for a suitable corner connection. Hinge elements support the door for pivoting movement relative to a vertical axis.

Extruded aluminum rail members may provide an aesthetically pleasing appearance, but are limited in terms of color and texture. While extruded aluminum elements may be formed with different profiles, a large number of frame profiles would require a significant inventory of parts.

The metal frame and door rail members, while providing suitable structural support and pleasing aesthetic appearance, readily conduct heat from outside the refrigerated display case, as well as serving as a condensation surface for water vapor which may be present in the ambient air. To reduce condensation and fogging, heater wires are sometimes placed in the frame and door rails to warm the rails and to thus inhibit condensation, especially in freezer cases. However, the consumption of energy by the heater wires adds an annual cost to the operation of the display case.

SUMMARY OF THE INVENTIONS

Frames, mullions and doors are described for refrigerated display cases having one or more aspects which contribute to improved thermal efficiency, energy savings or lower manufacturing costs. In one aspect of these inventions, a display case can meet or exceed one or more thermal performance standards set by a standards association. Greater flexibility and simplicity in the manufacturing process may also result from one or more aspects of these inventions.

In accordance with one aspect of one of the present inventions, a frame is provided for a refrigerated display case having a number of walls formed from cold rolled steel. The walls can be formed as an integral unit or separately and later brought together to form the frame. A steel frame has lower thermal conductivity than extruded aluminum, and provides a frame with improved thermal efficiency as well as improved energy efficiency. A steel frame can also reduce the cost of the display case when considering present-day costs of extruded aluminum. A steel framing can also improve the tolerances allowed in manufacturing and assembly, and can improve the form, fit and function of the display case.

In accordance with another aspect of one of the present inventions, a method is provided for forming a frame, such as a perimeter frame, mullions or door frame, which processes part of the frame prior to forming the frame element. For example, formation of mounting holes, hardware attachment points or other processing can be carried out before the frame element is formed into its final cross-sectional shape. As a result, different elements of a frame can be passed through the same forming or bending process without regard to whether the frame element is a top or bottom frame rail having mounting holes for hinge elements and hold-opens, or side frame rails having only openings for corner fasteners, or the like. The ability to process the frame elements in different ways provides more flexibility in the manufacturing process, and may result in lower overall costs with a lower rejection rate.

In the context of a perimeter frame, a frame for an opening in a refrigerated display case may include a first wall extending rearwardly, a second wall extending from the first wall in a second direction and a third wall extending from the second wall in a direction different from the second direction to define a recess between the first, second and third walls. A contact plate extends between the first and third walls closing the recess. The first, second and third walls are preferably formed from rolled steel and at least one of the walls includes a bend, for example for strength, to receive part of another component, or to hide an edge. In one preferred embodiment, each wall is substantially perpendicular to its adjacent wall. In another preferred embodiment, the contact plate includes a backing or carrier plate or mounting assembly that may carry the contact plate and that also may further insulate the contact plate from possible thermal transfer between the metal of the frame and the contact plate.

In accordance with a further aspect of one of the present inventions, a frame for an opening in a refrigerated display case may include first, second and third walls formed from rolled steel or stamped or other formed steel, and insulation to reduce thermal transfer from one side of the frame to the other. For example, the insulation may be provided in strips or sheets applied to the cold side of the frame, foamed or sprayed on, or applied as a blanket or in other ways. Insulation may improve the thermal and energy characteristics of the frame in many situations. Insulation may also be provided in the form of one or more air pockets created when a plastic or other cover is applied to the cold side of the frame. The plastic cover may include spacers, standoffs or other structures to keep most of the cover spaced from the surface of the frame, thereby providing the desired air pockets. Air flow within the pocket or pockets is preferably minimized. The cover may also be used to help in holding one or more components in place, such as contact plates, for example using zipper strips, snap features or similar devices.

In accordance with another aspect of one of the present inventions, the frame may be a door frame for surrounding or supporting a glass unit. The door frame is formed from rolled steel or stamped steel and includes a forward portion extending inwardly from a perimeter frame edge portion toward an edge of the forward glass pane and a first side portion extending rearwardly to a second wall, which in turn includes a third wall defining a groove. A plastic or other insulating element extends over part of the second wall to insulate the second wall. In one preferred embodiment, the insulating element keeps the steel from coming into direct contact with the cold of the refrigerated display case. For example, the insulating element may extend the complete distance from the metal door frame and contact a surface of the rear-most glass pane. The door may also include additional insulation to further improve the thermal efficiency.

In accordance with further aspects of the door frame, the rolled or stamped steel may include rolled-back edges to hide raw, cut edges. In another embodiment, the frame includes a further wall extending in the front-to-back direction and which, at least partly, helps to define a seat or back stop for the glass unit. The further wall may be exposed to direct contact with a glazing channel about the glass unit, or a portion of the insulating element may be inter-posed between the further wall and the glazing channel. In another embodiment, the insulating element may include a receptacle, groove or other means for receiving and retaining a sealing gasket. The sealing gasket may help to insulate the frame from the cold. While parts of the sealing gasket are preferably flexible, the insulating element is preferably substantially rigid plastic. In an additional embodiment, the rolled steel frame may include a groove, channel or other opening in a perimeter surface, such as a rear perimeter surface, for receiving part of the insulating element.

The door frame in accordance with one aspect of the present inventions can be configured as a drop in door assembly, and may include an opening in the metal frame directed toward the edges of the glass or the perimeter edge of the glass unit. In another configuration of a drop in unit, the rearward facing portion of the frame may be closed, or may include a wall which omits any opening toward the rear portion of the door. In a door frame configured as a pound-on assembly, the metal frame element may include a forward wall extending over part of a forward glass pane and a rearward wall extending over part of a rearward glass pane where the forward and rearward walls extend different lengths, the forward preferably more than the rearward wall. In another form, the sealing gasket preferably extends inwardly over the metal door rail sufficient to contact the rearward glass pane.

In a further aspect of one of the present inventions, a door is provided having a glass unit and a door frame for surrounding and supporting the glass unit. The door frame includes a forward portion and a rearward portion extending inwardly toward the glass unit, and a side wall extending between the forward and the rearward portions of the frame. An insulating portion engages the rearward portion and extends inwardly to contact a surface of the rearward glass pane. The insulating portion helps to insulate the door frame from any cold environment on the corresponding side of the door, such as the cold compartment of a refrigerated display case. In one preferred embodiment, no part of the door frame extends over the rearward glass pane of the glass unit. In another preferred embodiment, the insulating portion and the forward portion of the door frame extend over respective sides of the glass unit approximately the same amount. Insulation may be included in the insulating portion to further reduce thermal transfer between the cold side of the door and the door frame. In a further preferred form of the inventions, the insulating portion includes an anchor portion engaging a groove in the door frame.

In a further form of the present inventions, a mullion is formed from rolled steel, and may include insulation to insulate the mullion from the cold of the case. The insulation may be applied as a blanket, with an adhesive or as air pockets created by positioning or attachment of a mullion cover or similar structure.

In accordance with one aspect of one preferred form of the inventions, a glass unit is provided for use in doors for refrigerated display cases including at least two glass panels wherein at least one surface of one of the glass panels includes a coating for reflecting electromagnetic radiation such as infrared light. The coating is preferably a low emissivity coating such as pyrolytic tin oxide having an emissivity of 0.20 or less. The coating may be applied to the inside facing surface of one or both of the glass panels, and in the case of three or more glass panels, the coating is preferably applied to the inside-facing surfaces of each of the outer-most glass panels. In accordance with a further aspect of one of the present inventions, at least two adjacent glass panels, and preferably all of the glass panels in the glass unit, are separated and spaced apart by respective spacer assemblies. At least one of the spacer assemblies is formed from a low thermal conductivity spacer, such as those commonly referred to as warm edge technology spacers. "Warm edge technology", as used herein, shall be defined as spacer material that has desiccant embedded, surrounded or incorporated in a polymeric-based seal material. Spacers incorporating warm edge technology may or may not incorporate metal structures, metal foils or other inorganic materials, but often do include such materials. For example, in one preferred embodiment, at least one of the spacers includes a metal foil extending substantially across the entire width of the spacer material between the spaced apart glass panes. The metal foil preferably acts as a barrier to the passage of gases or molecules, for example moisture.

In another aspect of one preferred embodiment of the present inventions, a glass unit is provided, for example for use as a refrigerated display case swing door, first and second glass panels have surfaces facing each other, such as inside surfaces, each having low emissivity coatings on those facing surfaces. Preferably an intermediate glass panel extends between the first and second glass panels. Each of the glass panels is separated from the adjacent glass panel by warm edge spacers. In a preferred form of one of the inventions, the glass unit includes a frame extending about and supporting at least one of the glass panels, and preferably all the glass panels, and a hinge assembly allowing the glass unit and frame assembly to swing open and closed relative to a supporting frame. Under some circumstances, a refrigerated display case door having a triple pane glass unit with the inside surfaces of the outer glass panels coated with a low emissivity coating, and with each of the glass panels separated from adjacent glass panels using spacers such as the Comfort Seal spacer can avoid using any heat on any of the glass panels that would ordinarily be used to reduce or eliminate moisture condensation. Consequently, refrigerated display cases can be designed for lower energy consumption while still maintaining clear glass for viewing product for all or a substantial portion of the time throughout a given day under normal operating conditions.

In accordance with a further aspect of one of the preferred embodiments of the present inventions, the foregoing refrigerated display case door can be constructed with spacers formed with a desiccant-embedded sealant on the inside of the spacer relative to a metal or other foil for inhibiting or blocking movement of gases across the spacer, and a sealant on the opposite side of the foil for sealing between the adjacent glass panels. A relatively harder polymeric structure is embedded in the sealant for helping to maintain the proper spacing between adjacent glass panels. Additionally, the free ends of the metal foil can each terminate at a sealing bead and sealed to the surface of the respective adjacent glass panel through the sealing bead.

BRIEF DESCRIPTION OF THE DRAWINGS

FIG. 19 is an isometric view of an alternate mullion mounting bracket.

FIG. 20 is a detail of a part of a frame element assembly or a mullion assembly in accordance with another form one aspect of the present inventions showing support of a contact plate carrier.

DETAILED DESCRIPTION OF THE PREFERRED EMBODIMENTS

The following specification taken in conjunction with the drawings sets forth the preferred embodiments of the present inventions in such a manner that any person skilled in the art can make and use the inventions. The embodiments of the inventions disclosed herein are the best modes contemplated by the inventor for carrying out the inventions in a commercial environment, although it should be understood that various modifications can be accomplished within the parameters of the present inventions.

The frames, "frame" referring generically to the perimeter or surrounding frame and mullions as well as door frames, described herein can be used in a number of applications for framing and providing access to enclosures, which may include for example display cases and the like. These inventions are particularly suited to environments such as refrigerated display cases, but it should be understood that they may also apply to other uses as well. The assemblies and methods described herein are given in the context of examples of specific applications, and their extension to other applications will be understood from the context of the examples. In one example, the frames are subject to relatively extreme temperature conditions that are found in refrigerated display cases. Coolers are one type of refrigerated display case and operate at approximately 38 degrees Farenheit. Freezers operate below zero degrees Farenheit. In these relatively cold conditions, the portions of the frames that are exposed to relatively more humid ambient air may typically be cooler than other surfaces in the same area because of their proximity to the cold portion of the case. Consequently, the surrounding humid air may lead to condensation of moisture on the colder surfaces of the frames. In the present applications, even without heat being applied to the frame electrically or otherwise, moisture condensation occurs less frequently, if at all, resulting in greater operating energy efficiency.

Figures 1, 2:
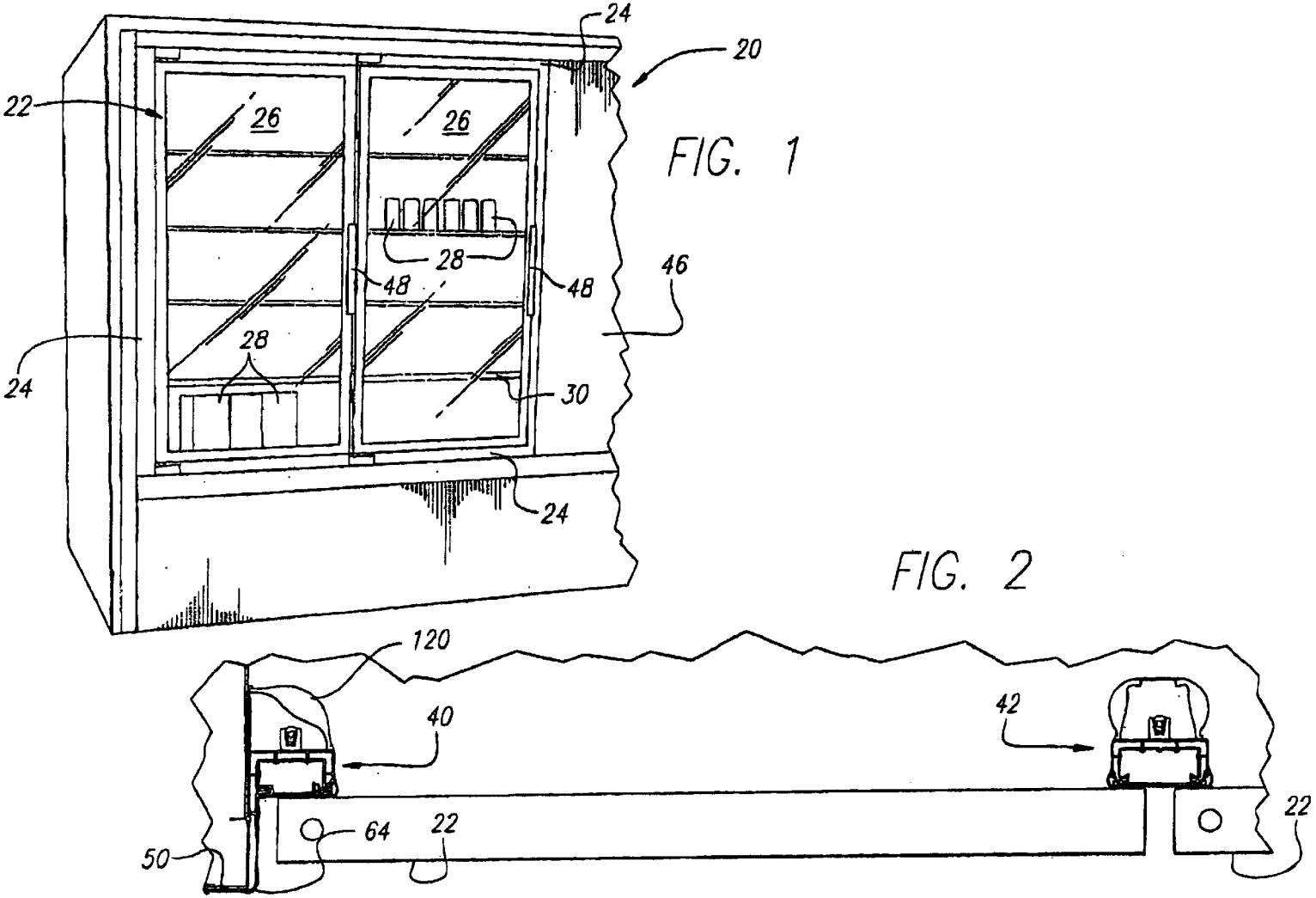
FIG. 1 is a front perspective view of a refrigerated display case containing product for display and in which one or more aspects of the present inventions may be used.
FIG. 2 is a top plan and partial cutaway view of the refrigerated display case of FIG. 1.
Figure 4:
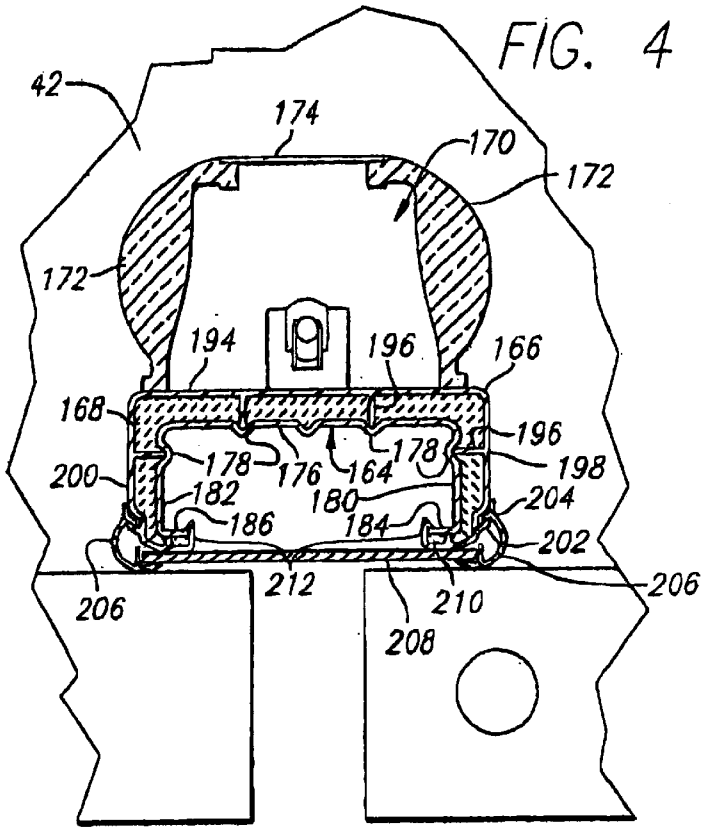
FIG. 4 is a horizontal cross-section of a center mullion in accordance with one aspect of one of the present inventions.
Figure 3:
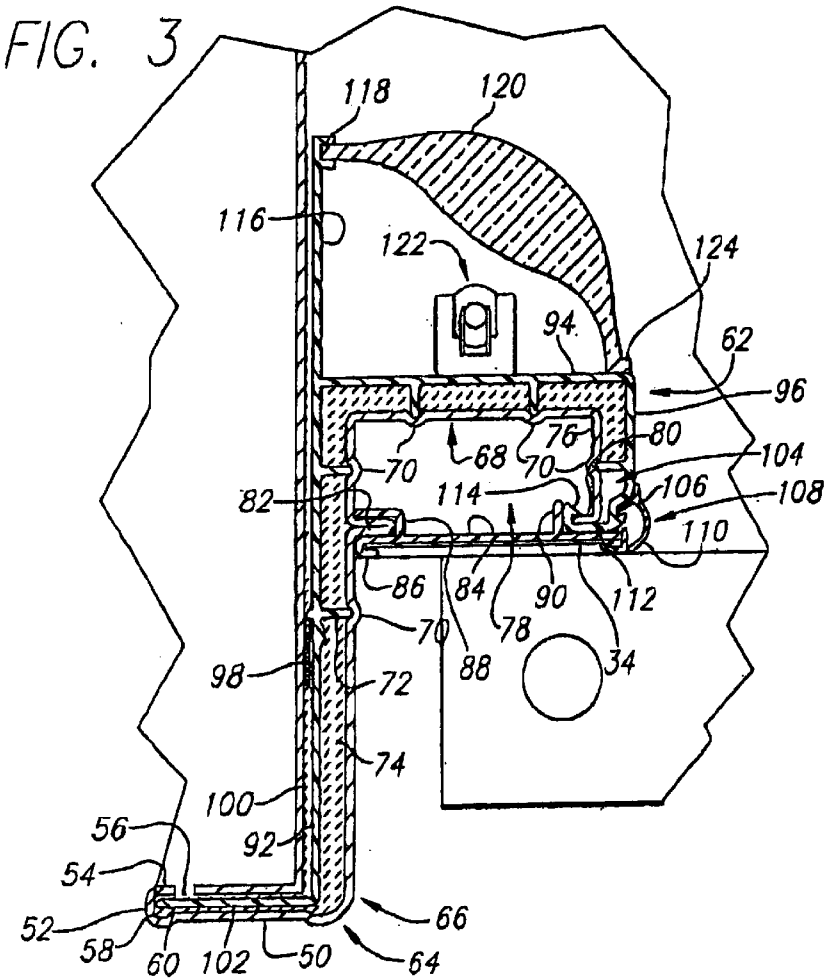
FIG. 3 is a horizontal cross-section, partial cutaway and detail view of an end mullion or left side frame member in accordance with one aspect of one of the present inventions.

In accordance with one aspect of the present inventions, surrounding frame, door rail and mullion configurations or combinations thereof can be used in a display case, such as a refrigerated display case 20 (FIG. 1). The display case includes doors 22 (shown generically in FIGS. 1–4 and 6) mounted in a surrounding frame 24. The doors 22 have glass panels 26, which allow someone, such as a customer in a supermarket, to look through the panels 26 at items 28 displayed on shelves 30 inside the case 20. The items 28 inside the display case 20 may or may not be refrigerated items, such as frozen foods. Typical refrigerated display cases, for example, use shelves that are assembled in units approximately 30 inches in length, across the front of the unit. Other details about conventional refrigerated display cases are included in U.S. Pat. No. 5,895,111, the specification and drawings of which are incorporated herein by reference.

Figure 5:
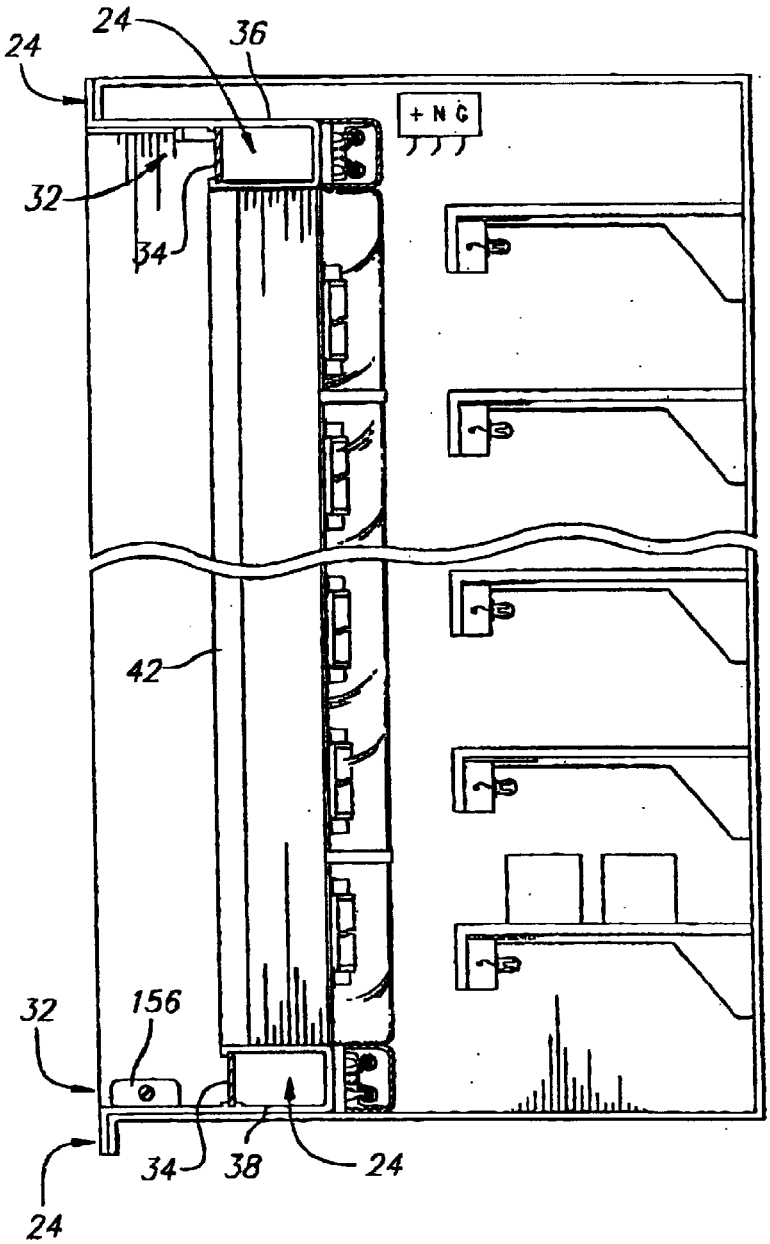
FIG. 5 is a side elevation view of a display case incorporating frame elements in accordance with one aspect of one of the present inventions.

The doors 22 can be swing doors supported on hinges 32 (FIG. 7) or sliding doors (not shown). Most refrigerated display cases having multiple shelves for holding and displaying product are closed with doors. The doors close and create a thermal and airtight seal against contact plates 34 in the frame 24 (FIG. 5) using gaskets (not shown in FIG. 5). Along the tops and bottoms of the doors, the doors seal against upper and lower horizontal frame members, 36 and 38, respectively, and along the sides, the doors seal against a side frame member 40 (FIG. 2) or a center mullion 42 (FIGS. 2 and 5). Each mullion 42 extends vertically between the top 36 and bottom 38 frame members, and is typically considered a frame element, supporting the structure and providing sealing surfaces for the sides of the doors. Conventional mullions typically house wiring for supplying electricity to various electrical components such as lighting systems, including ballasts for energizing fluorescent light sources. This wiring and the ballasts take up considerable space in the mullion, and produce relatively complicated wiring schemes to supply the electrical energy to the fluorescent lamps.

Figure 10:
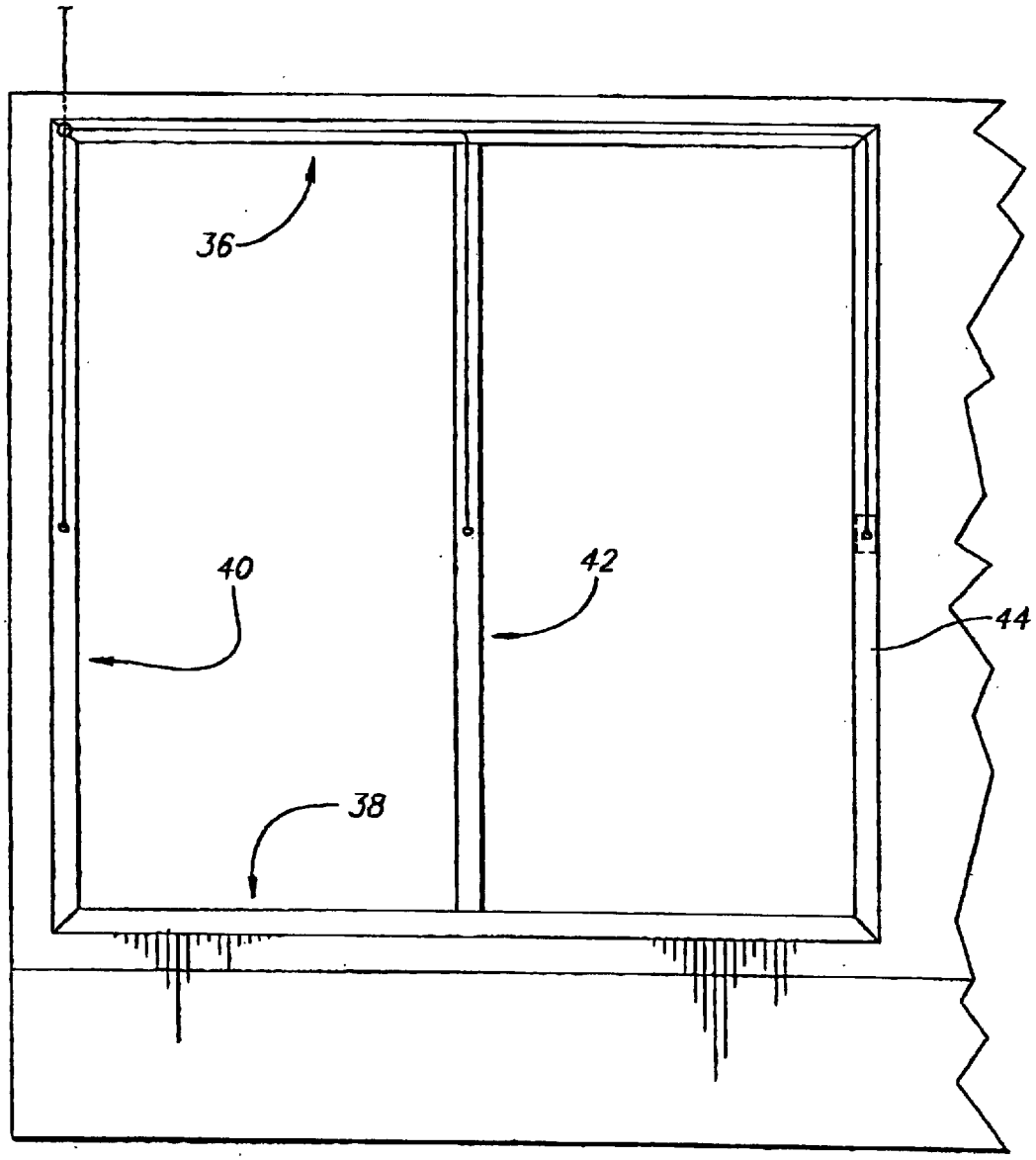
FIG. 10 is a front elevation viewing of a display case without doors showing a wiring arrangement for providing current to lamp assemblies.

Considering the surrounding or perimeter frame elements in more detail, the frame elements will be discussed in the context of a two-door case. However, it should be understood that the description of the perimeter frames can be extended to frame configurations for cases having any number of doors in a manner similar to that in which conventional perimeter frames can be extended from a two-door assembly to multiple doors. In a two-door case, the upper horizontal frame element 36, the lower horizontal frame element 38, the left vertical frame element or end mullion 40 and the right vertical frame element or end mullion 44 (FIG. 10) will have the same or essentially identical configurations. They are mitered at the ends so they can be joined, as described more fully below, to form a rectangular frame assembly that can be installed and anchored, fastened or otherwise supported by the walls 46 (FIG. 1) of the case. The doors 22 can then be mounted and supported for pivoting movement in the surrounding frame using hinge elements such as those described in U.S. Pat. Nos. 4,671,582 and 4,696,078. Handles 48 are mounted on the outsides of the doors on the sides opposite the hinges for opening and closing the doors. The upper edge portions of the doors seal against the upper frame rail element 36, and the lower edge portions of the doors seal against the lower frame rail element 38. The left side edge portion of the left door seals against the left rail element 40 and the right side edge portion of the left door seals against the mullion 42. The left side edge portion of the right door seals against the center mullion 42 and the right side edge portion of the right door seals against the right frame rail element 44. The sealing of the doors against the contact plates 34 is achieved through the gasket strips attached to or otherwise supported by rearward-facing portions of the door rails, as described more fully below.

Considering the perimeter frame rails in more detail, each perimeter frame rail preferably has the same configuration for all four sides of the surrounding frames. While the present invention allows flexibility in the designs of the frames, and while different sides of the surrounding frames can incorporate different configurations, it will be assumed that each of the perimeter frame rail elements have the same configuration. In the preferred embodiment, each perimeter frame rail includes a decorator strip 50 (FIG. 3) extending laterally across the front of the case 46 to a rolled edge 52. The decorator strip 50 can take any number of configurations and can present any number of different feature characteristics as desired, some of which may include coatings, texture, tape and the like. The rolled edge 52 preferably curves inwardly and back along a back wall 54 toward the opening of the case to an end 56 leaving a gap or groove 58 extending the length of the perimeter frame rail for strength and preferably for receiving an edge 60 of a perimeter frame cover 62. The opposite end of the decorator strip 50 ends at a preferably round corner 64.

Each perimeter frame rail preferably includes a first wall 66 extending rearwardly from a forward portion of the opening to a second wall 68 formed preferably substantially perpendicular to the first wall 66. The first wall preferably includes at least one and preferably two bends, grooves, crests or other surface discontinuities 70 extending longitudinally the length of each perimeter frame rail. The crests 70 provide strength and also provide channels or recesses into which a standoff or other spacer element 72 on the perimeter frame cover 62 can rest. A gap is formed between the perimeter frame rail and the cover 62 to provide an insulating air gap 74 between them, which can be maintained as an insulating air gap or which can accommodate insulation. The second wall 68 also preferably includes spaced apart crests 70 preferably having the same structure and function.

A third wall 76 extends from the second wall 68 in a direction different from that of the second wall, preferably perpendicular to the second wall, to define a recess 78 between the first, second and third walls. The third wall preferably includes at least one crest 70. The third wall preferably terminates at an end wall 80, extending preferably parallel to the second wall and over part of the recess 78 to act as an anchor plate and support for the corresponding end of the cover 62.

In the preferred embodiment, the first wall 66 includes a fold, hem, crease or other surface discontinuity 82 extending from the first wall in the opposite direction of and toward the end wall 80 and over part of the recess 78. The fold 82 forms part of an anchor and support surface for a contact plate carrier 84 for covering the recess 78 and for carrying the contact plate 34. The contact plate 34 may be any conventional contact plate. The contact plate carrier 84 can take any number of configurations, but preferably keeps the contact plate flat and reliably holds it in place on the perimeter frame elements and under the gasket strips of the doors. In the preferred embodiment, the contact plate carrier 84 is formed from an extruded plastic such as rigid PVC. The carrier extends across the entire opening of the recess and rests against the fold 82 and against the perimeter frame cover 62. The contact plate carrier preferably includes a forwardly-extending lip 86 defining a groove for receiving one edge of the contact plate 34, and an oppositely-extending flange element 88 defining a groove for fitting over the fold 82. The carrier 84 also includes a stabilizing wall 90 extending into the recess 78 for resting against the end of the perimeter frame cover 62 and helping to properly laterally position the carrier over the recess 78.

Considering perimeter frame cover 62 in more detail, the cover 62 preferably covers and insulates the frame from the cold environment of the display case. It can also serve as a carrier of components, such as the contact plate carrier. The cover preferably includes a first wall 92, second wall 94 and third wall 96, corresponding to the first, second and third walls of the perimeter frame rail, respectively. The first and second walls 92 and 94, respectively, each preferably includes at least two standoffs 72, while the third wall preferably includes at least one standoff 72. The standoffs help to maintain the gap between the cover and the frame, to help maintain the insulating quality of the cover arrangement. The walls and the standoffs are preferably substantially straight and extend longitudinally the length of the perimeter frame rail. Each perimeter frame rail cover also preferably includes a flexible flange member 98 for sealing against the wall 100 of the case into which the frame assembly is placed. The frame cover also includes a fourth wall 102 terminating in edge 60 extending into the groove 58.

The gaps 74 between the perimeter frame rail elements and the perimeter frame covers provide an insulating layer between the cold interior of the display case and the perimeter frame rail elements. The insulating layer can take the form of air gaps 74, or may be insulating material such as felt, foam or other insulation, which may be applied as tape or in other forms. The insulation may be similar or identical to conventional insulations presently in use. If the insulation is an air gap, the air gap may be between 0.150 and 0.200 inch or more, often depending on the insulating value desired and the available space. If the insulation is an additional material, it may be loose or may be adhered to the frame rail elements or to the surrounding frame covers 62. The insulation may be sprayed onto one or the other of the facing surfaces, or applied in other ways. The insulation may be applied to all or fewer than all of the available surfaces, as desired. Air flow in the gaps 74 is preferably minimized. For example, the ends of the frame covers 62 can be sealed with an appropriate sealant, or can be sealed, glued or otherwise made continuous with the adjacent frame covers so that there is a continuous, unbroken, preferably plastic surface facing the cold interior of the display case formed by the perimeter frame rail covers over the perimeter frame rail elements.

The end of the perimeter frame cover at the third wall preferably includes a retaining groove 104 for receiving and retaining an engagement end 106 of a conventional zipper strip 108 or a similarly-shaped retaining or engagement end on the contact plate carrier. The other end 110 of the zipper strip engages and holds in place the contact plate 34 against the carrier 84. The end of the perimeter frame cover also includes a carrier support surface 112 sandwiched between the end wall 80 of the perimeter frame rail and the carrier 84. The end of the perimeter frame cover terminates in an engagement hook 114 curving around or extending over the exposed edge of the perimeter frame end 80 and behind it to secure the end of the perimeter frame rail cover to the frame rail.

In one preferred embodiment, the perimeter frame rail cover includes a relatively rigid flange 116 extending rearwardly to engage and support an end 118 of a lens 120. The lens 120 distributes light into the display case from a light source 122 mounted, attached or otherwise supported by the perimeter frame rail cover and/or the perimeter frame rail. The other end 124 of the lens may be supported by the perimeter frame rail cover in any desired manner. Reflectors or other optic elements besides lens 120 may also be included as desired. Lens arrangements are described in more detail in U.S. Pat. No. 5,895,111.

The perimeter frame rail is preferably formed from a suitable steel that can be bent, formed and/or stamped into the desired shape. In a preferred embodiment, steel sheets such as eighteen gauge Galvalume or Jetcoat steel, such as that used for conventional shelf posts in refrigerated display cases, are preferably cut to size and stamped so as to have the desired holes, openings or other attributes for mounting hardware, receiving fasteners or for any other desired function. The sheets can then be roll formed into the desired shape and configuration for use as a perimeter frame rail. This process does not require extrusion forming of linear elements. Additionally, steel has a lower co-efficient of thermal conductivity, thereby giving the frame assembly improved thermal performance. The frame rails are preferably painted, coated, powder coated or otherwise surface treated to have an attractive finish, and preferably to make the perimeter frame rails impervious to moisture and oxidation.

The perimeter frame rail covers are preferably formed from rigid PVC such as that typically used in refrigerated display cases for covers, and may be about 0.050 inch thick at the standard wall portions. Other areas may be thicker or thinner, as desired for structural support or for flexibility.

Preferably, the perimeter frame rail assemblies use no electrically generated heat to raise the temperatures of the surfaces exposed to ambient air, and meet the moisture condensation standards set by the Commercial Refrigeration Manufacturers Association (CRMA). In one embodiment using steel and a perimeter frame rail cover having substantially the same thickness and formed from substantially the same material as conventional perimeter frame rail covers and polystyrene foam insulation, little or no significant condensation was detected for a −12 degree case temperature, 75 degrees Farenheit ambient temperature and 83 percent relative humidity.

Figure 13:
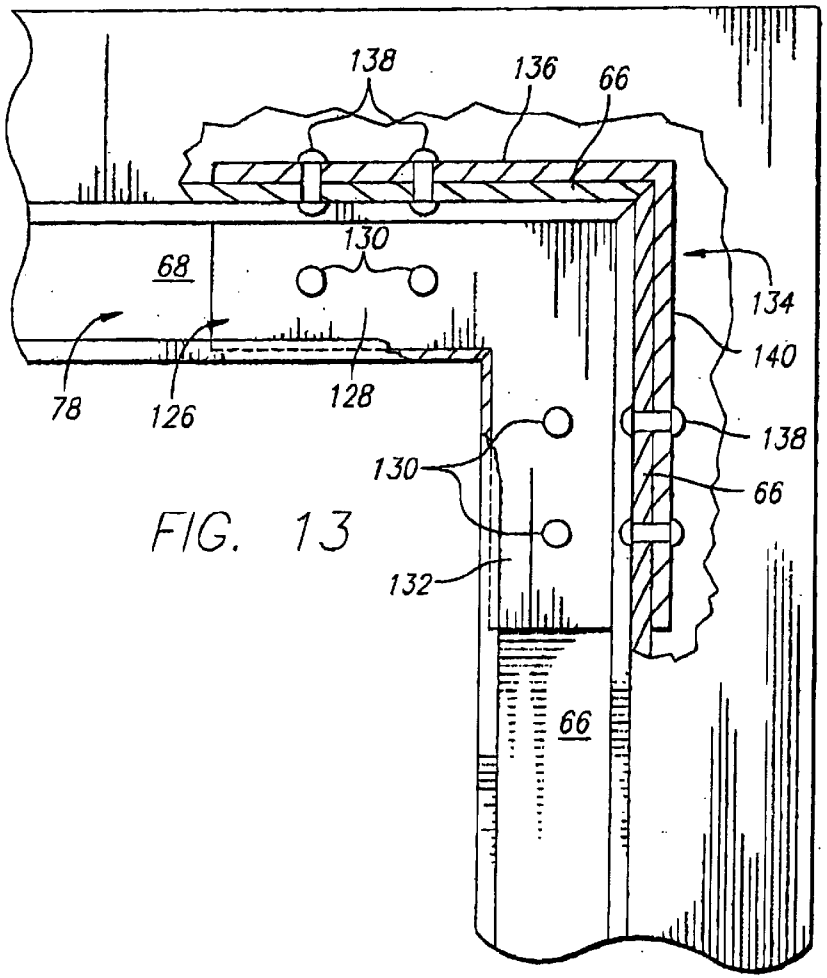
FIG. 13 is a detail and partial cut away view of a surrounding frame assembly in accordance with another aspect of one of the present inventions.

The perimeter frame rails are preferably held together at mitered corners by one or more corner brackets riveted, fastened or otherwise reliably fixed preferably at the corners of adjacent perimeter frame rail elements. In one preferred embodiment, a flat corner angle plate 126 (FIG. 13) includes a first leg 128 fastened through rivets 130 to the second wall 68 of one frame rail element. The corner plate 126 includes a second leg 132 fastened through rivets 130 to the adjacent frame rail element. The corner plate 126 is preferably positioned in the recess 78 and fastened at the back of the recess to the second wall 68. The corner plate 126 could also be formed to conform to the ridges 70 in the second wall 68 so that the plate is flush against the second wall 68. The corner plate may also include one or more perpendicularly extending side walls (not shown) extending preferably from the edges of the plate, multiple ones of which may combine to form a U-channel angle bracket, for additional strength.

In the preferred embodiment, a second corner angle bracket 134 includes a first leg 136 fastened through rivets 138 to one end of the first wall 66 of one perimeter frame rail element. The bracket 134 also includes a second leg 140 fastened through rivets 138 to one end of the first wall 66 of the adjacent perimeter frame rail element. Similar corner connections are preferably made at each right angle corner in the perimeter frame.

Figure 14:
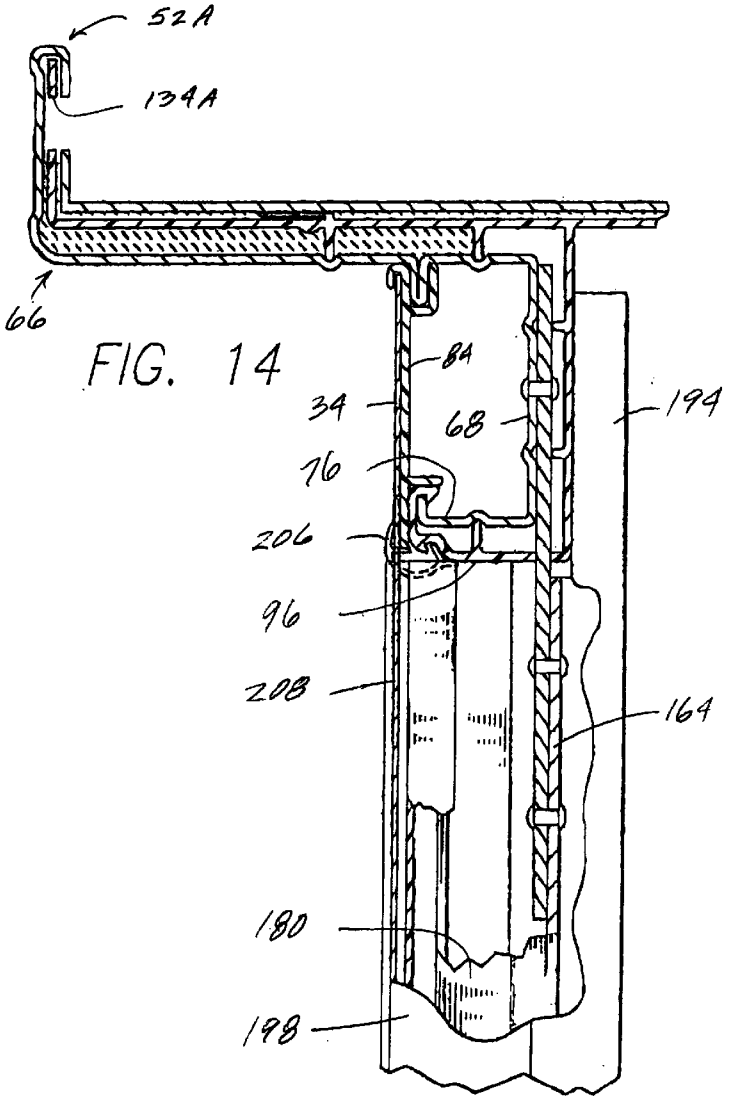
FIG. 14 is a vertical cross-section and partial cutaway view of an upper perimeter frame element and center mullion in accordance with a further aspect of one of the present inventions.

Other forms of connecting the various frame or structural elements may be used in conjunction with or instead of the corner brackets 132 and/or 134. For example, the structures can be entirely welded or welded in part along with other assembly means, including other fasteners, and the like. Welding is not preferred because welding may change the characteristics of the metal. However, the corner brackets or variations on them are suitable. One alternative or additional form of joining the adjacent frame elements includes corner brackets 134A (FIG. 14) inserted into an extended rolled back corner 52A and held in place by suitable fasteners or preferably by peening or otherwise engaging the free end of the roll back to the bracket 134A. The bracket 134A may be a right angle plate with each leg, one of which is shown in FIG. 14, being about an inch more or less in length. The bracket 134A may be corrugated or otherwise shaped to securely engage the corner portions of the frame elements at their other edges. The bracket 134A may be incorporated into or made integral with one of the ends of a frame rail element by suitable cutting, punching or forming of each frame rail element so that the bracket will extend into the adjacent groove formed by the roll back 52. The roll back preferably extends farther along the back of the frame than the roll back 52, and the plastic is preferably cut shorter.

The frame elements can be fixed or otherwise supported within the conventional opening in any number of ways. One way to mount the frame elements within the opening includes fasteners such as screws (not shown) threaded through openings in the sides 72 and 92 into the wall of the opening, shown generically but which may take any conventional form. The openings can be formed by punching or drilling and coning to accommodate the fastener head. A plastic or metal sleeve or other spacer may be placed between the walls 72 and 92 to reduce the possibility that over-torquing of the fastener deforms the metal.

Figure 15:
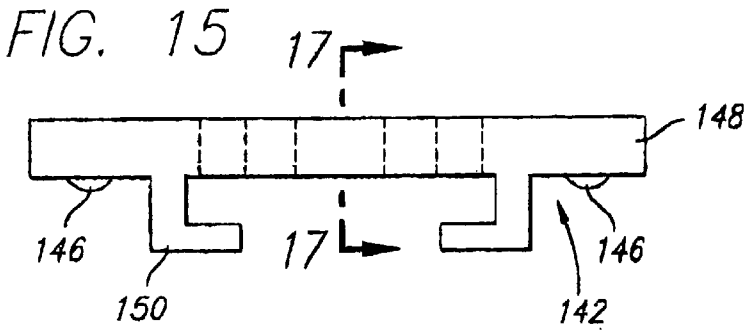
FIG. 15 is a front elevation view of a mounting element for a hinge for use with a frame of one of a present inventions.
Figure 16:
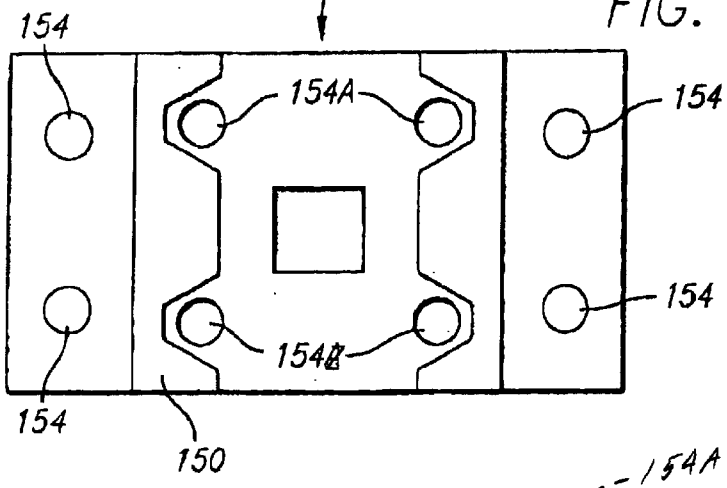
FIG. 16 is a bottom plan view of the mounting element of FIG. 16.
Figure 17:
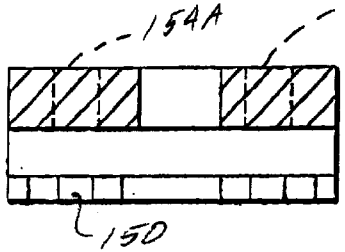
FIG. 17 is a cross sectional view of the mounting element of FIG. 15 taken along line 17—17.

Various mounting hardware for mounting and controlling door movement is mounted to the perimeter frame rail elements. For example, hinge mounting hardware such as gib 142 can be mounted, fastened, riveted to or otherwise supported by the upper perimeter frame rail element 144 (FIGS. 7 and 8) through one or more fasteners 146. The gib 142 (FIGS. 15 and 16) can include a flat plate 148 to back against the first wall 66 and a carrier bracket 150 for receiving and supporting a hinge pin 152 (FIG. 8). The hinge pin 152 can have the same or similar form and structure as the hinge pins shown and described in U.S. Pat. No. 4,671,582, with or without the electrical connections. Electrical connections can be included if the door rails are to be heated or if current is to be supplied to a conductive coating on the glass of one of the glass panes in the glass unit. Because of the strength of the steel used in the perimeter frame rail elements, the gib 142 can be fastened to the first wall 66 without having part of the gib extend into or engage the wall of the perimeter frame rail. Apertures 154 can be formed in the plate 148 for accepting the fasteners 146. Alternatively or additionally, apertures 154A may be positioned within the outline of the carrier bracket 150. The apertures 154A can be used exclusively while omitting the plates in where the apertures 154 are formed for mounting the gib with a smaller footprint. The apertures 154 can be used to advantage with a double gib, for example. The gib and fasteners 146 may also be supported by the angle bracket 140 for added strength, or another suitable backing plate included solely for supporting the gib. Other hardware used on or in conjunction with the perimeter frame or the door rails include switches, for example delay switches or on/off switches and connectors.

Other door mounting hardware can be mounted to the first wall 66. For example, the hinge and door closure mechanism 156 (FIG. 5) can be mounted to the bottom perimeter frame rail with appropriate fasteners through openings formed in the wall of the frame rail. The mounting of the closure may achieved in a way similar to the way in which the gib 142 is mounted, such as by surface mounting with a suitable backing plate similar to that described above with respect to FIG. 7. A door closure that can be used is shown, for example, in U.S. Pat. No. 4,696,078.

Figure 6:
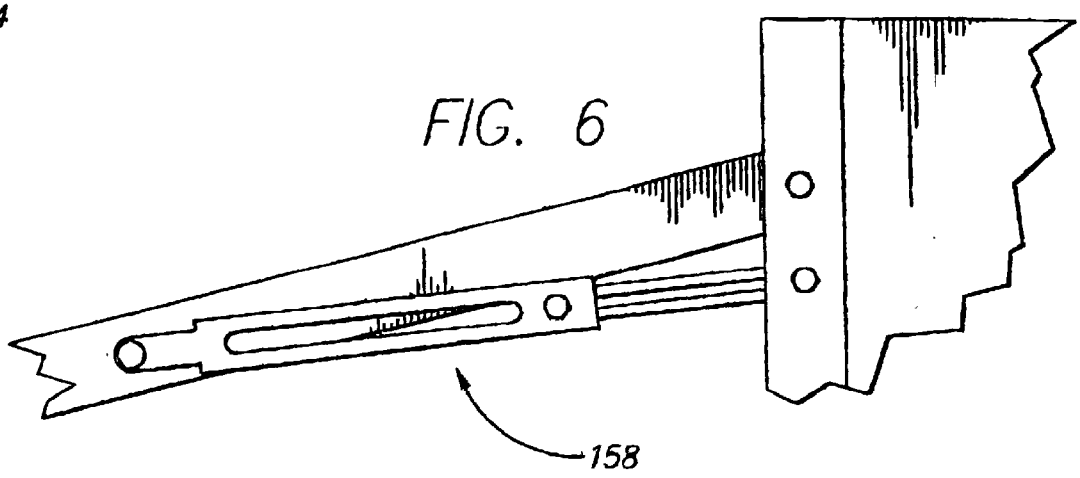
FIG. 6 is a top plan view and partial cutaway of a door and frame assembly incorporating several aspects of the present inventions.
Figure 7:
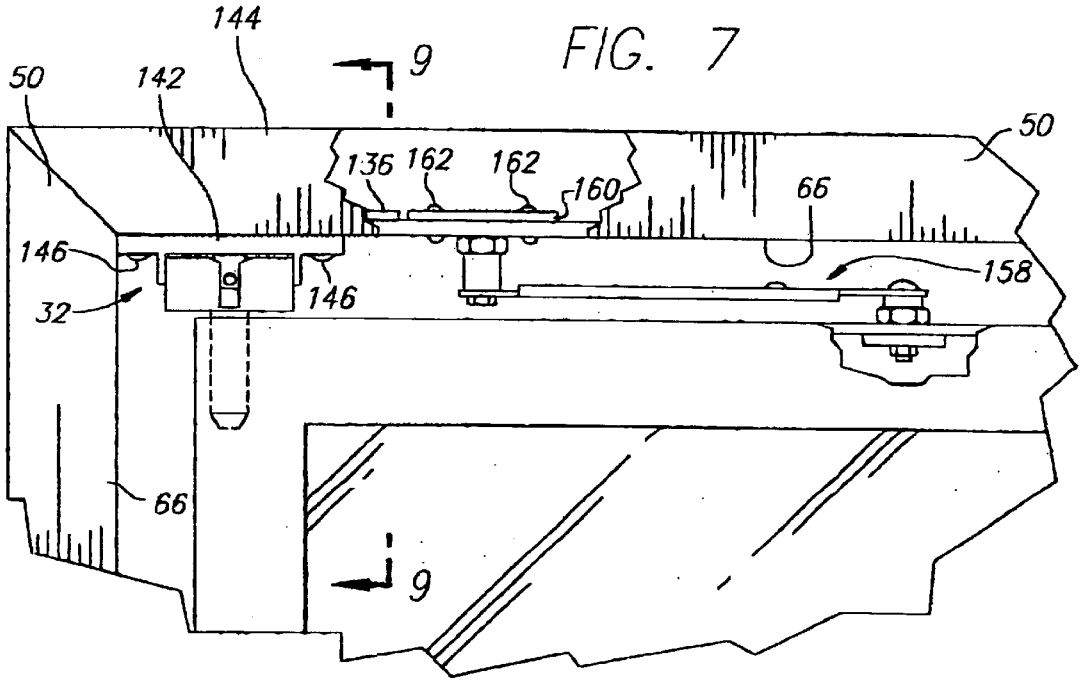
FIG. 7 is a front elevation view and partial cutaway of the upper left portion of a refrigerated display case including a surrounding frame and door frame incorporating several aspects of the present inventions.
Figure 8:
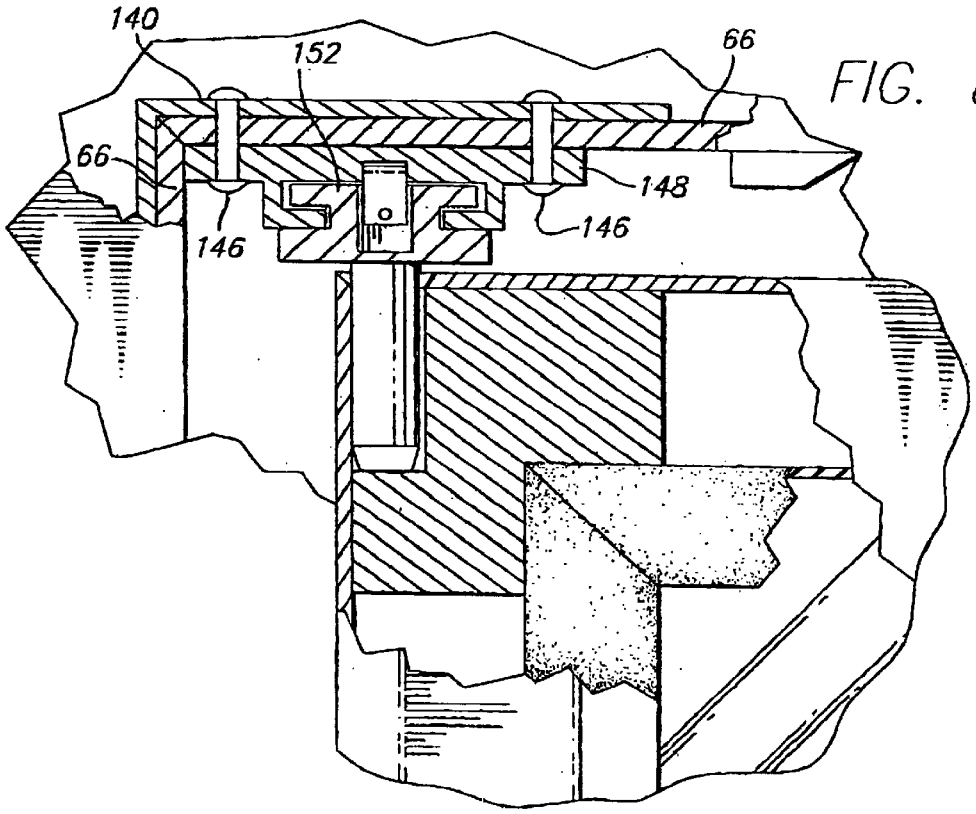
FIG. 8 is a partial detail and cutaway front elevation view of an upper left portion of the surrounding frame and door of FIG. 7.
Figure 9:
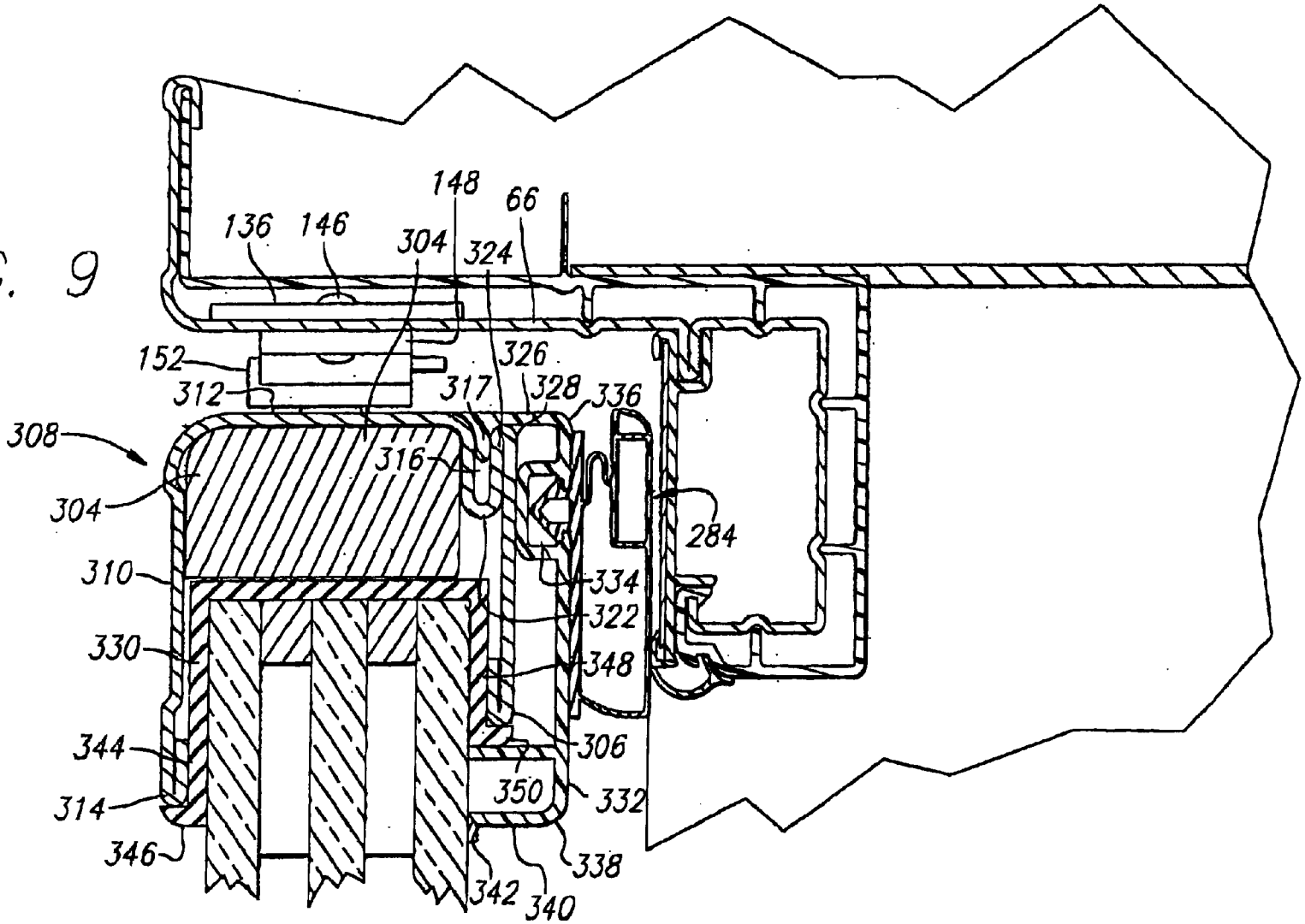
FIG. 9 is a vertical cross-section and partial cutaway view of an upper frame element and door frame in accordance with several aspects of the present inventions.

Other hardware that can also be mounted to the frame rails includes a door hold opening and/or door stop, such as the door stop 158 shown in FIGS. 6 and 7 mounted to the first wall 66 of the upper frame rail. The door stop may be anchored to the first wall 66 of the upper perimeter frame rail through a mounting or backing plate 160 and suitable fasteners 162. As with the gib 142, the mounting hardware for the door stop does not need to otherwise engage any opening in the frame rail element, due to the strength of the steel. Other hardware can be mounted to any of the perimeter frame rails as desired.

The center mullion 42 (FIG. 4) is also preferably formed as a combination of roll formed steel 164 and mullion cover 166 with an insulation layer 168 between. The mullion 164 is preferably formed using substantially the same process as is used for stamping and forming the perimeter frame rail elements, and is preferably painted or powder coated in the same way and with the same material. Likewise, the mullion cover 166 is preferably formed from the same material and has similar characteristics as the perimeter frame cover 62, including being made from the same material, with substantially the same thickness, substantially the same standoffs and dimensioned to produce approximately the same insulation spacing between the cover and the mullion 164. Precise dimensions may differ because of other considerations such as positioning of other components, and the like. The insulation is also preferably the same. The center mullion 42 will typically also include a light source 170 and may include lenses 172 connected by a bridge 174 and mounted, supported or otherwise positioned on the center mullion as desired.

In a preferred embodiment, the mullion 164 includes a first back wall 176 including a plurality, preferably at least three, bends 178 having functions and structures similar to those described above with respect to the bends 70. The back wall 176 is otherwise preferably flat and straight and extends longitudinally between the upper and lower perimeter frame rail elements. The mullion also preferably includes a right side wall 180 and a left side wall 182 each including their own bends 178. Each side wall terminates in a respective end wall 184 and 186, respectively, extending inwardly toward each other to narrow the opening to the recess defined by the back and side walls. The end walls 184 and 186 support and engage respective ends of the mullion cover 166 for retaining the mullion cover in place. The center mullion is preferably held in place with respect to the upper and lower perimeter frame rails by mounting plates 188 (one of which is shown in FIG. 14) with preferably four or more suitable fasteners 190 (two of which are shown) through the mullion wall 164, and through the second wall 68 with preferably two or more fasteners 192 (one of which is shown). The plate 188 can be a simple rectangular steel plate for reliably holding and positioning the mullion in place, or may be a mounting plate such as that shown in FIG. 19, described below, shaped to more closely conform to the configuration of the mullion and the frame rail element to which it is mounted. The mounting bracket may also be formed to include grooves complimentary to those in the mullion and frame rails to more closely engage the walls of the mullion and the frame rails. The sides of the mullion and of the cover plastic are cut away at the points where there would otherwise be an overlap between the mullion assembly and the perimeter frame element. Preferably, the back of the mullion and the cover extend to overlap the back of the perimeter frame, either with or without the cover plastic 94.

Other junction configurations are possible for bringing the mullion and the frame elements together. For example, all or part of the insulating plastic of the perimeter frame can be cut away in the area where the center mullion would extend, to allow center mullion to be directly adjacent the metal of the perimeter frame. Additionally, the back portion of the center mullion need not extend the entire height of the back of the perimeter frame, but may stop short or stop flush with the cover wall 96.

The mullion cover preferably includes a first back wall 194 with a plurality of standoffs 196. The first back wall preferably extends straight to a right side wall 198 and a left side wall 200, each with their own standoffs 196. In this embodiment of the mullion cover, each of the side walls terminate in identical end walls. Each end wall includes an engagement surface 202 for engaging and retaining one end 204 of a zipper strip 206 for holding a contact plate 208 in place against a support wall 210 on each end wall. Each end wall includes a terminal engagement wall 212 having a hook or other engagement surface for passing over the exposed edge of walls 184 and 186 and engaging the rearward-facing surfaces of walls 184 and 186. Other configurations are also possible for holding the mullion covers in place and also for holding the contact plates in place.

The contact plate extends upwardly and downwardly through cuts formed in the zipper strips 108 to be flush the adjacent contact plates in the corresponding upper and lower frame rails. Alternatively, they can extend to the tops and bottoms of the frame elements, and adjacent the first walls 66, by passing between and flush with cut portions of the horizontal contact plates. Sections of the upper and lower horizontal contact plates can be cut therefrom and having widths equal to the width of the mullion contact plate, to allow the mullion contact plate to fit in between. Other combinations are also possible for matching the adjacent contact plates.

Figure 18:
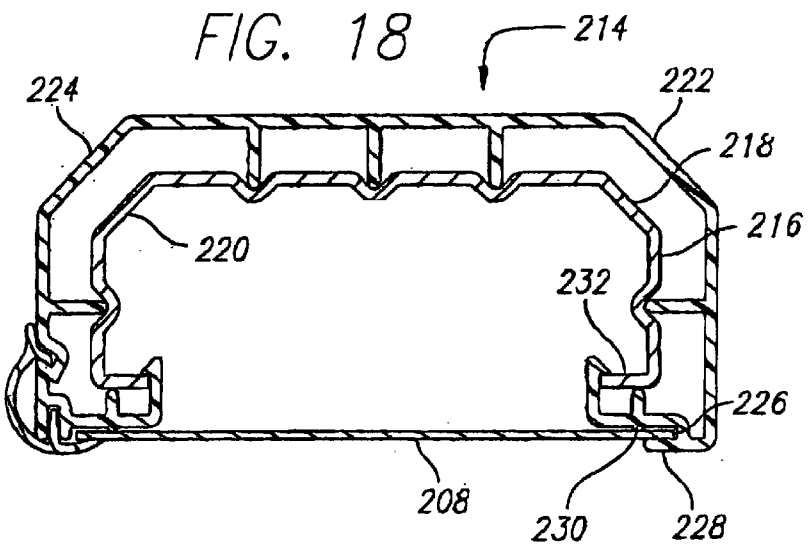
FIG. 18 is a horizontal cross section of a further embodiment of a center mullion in accordance with a further aspect of one of the present inventions.

In another embodiment of a center mullion assembly 214 (FIG. 18), the materials are substantially the same but the shapes are modified and the contact plate 208 is supported in another way. The mullion 216 includes a right slanted wall 218 and a left slanted wall 220 to provide additional strength to the mullion column. The mullion cover includes a corresponding right slanted wall 222 and a corresponding left slanted wall 224. Additionally, one end, the right end shown in FIG. 18, includes a groove 226 formed by a longitudinally extending lip 228 and a longitudinally extending ridge 230 for contacting the contact plate 208 and helping to hold it in place against the lip 228. The remainder of the end of the mullion cover extends over and engages the mullion end wall 232. The embodiment of the center mullion 214 shown in FIG. 18 includes back walls and side walls similar to those described with respect to FIG. 4.

In either mullion configuration, one or more openings may be formed in that part of the third perimeter frame rail wall 76 surrounded by the mullion walls to allow wiring into or out of the mullion and into the recess in the perimeter frame rail. Openings can include protective bushings or can be sealed or otherwise trimmed to protect wires, to make movement of wires easier, and the like.

FIG. 19 shows an alternative mounting bracket 188A for the center mullions, and that can be used with either mullion configuration described. It includes a pair of oppositely-facing mounting plates 188B for being fastened to the insides of side walls 180 and 182 of the mullion and a mounting plate 188C for mounting to the back of the second wall 68 of the perimeter frame rail. Other mounting arrangements can also be used.

The contact plates for the perimeter frame rails and for the center mullions can also be mounted with a contact plate carrier, and can be mounted without one or both zipper strips, as shown in the mounting arrangement in FIG. 20. In this configuration, the contact plate carrier includes a side wall 233 extending rearwardly from the main part of the carrier to a hook line 233A for extending into and engaging the groove 202 in the cover (groove 104 in the case of the perimeter frame rail cover) to hold the contact plate carrier in place. This or similar constructions can be used to hold the contact plates and/or their carriers in place.

The surrounding frame assembly of one aspect of the present inventions can accommodate and support a number of different types of doors. However, it is preferred that the doors used with the frame assembly described herein also have an energy consumption that is reduced or entirely eliminated. For example, with the designs discussed herein, energy used in the doors can be reduced while still achieving a condensation-free door on a −12 degree Farenheit case with 75 degree Farenheit ambient temperature and 73% relative humidity. While conditions vary in different areas, and such conditions may make heated door frames or glass in the conventional manner desirable, the doors incorporating aspects of the present inventions give the options of eliminating added energy from the doors entirely in some situations.

In accordance with one aspect of the present inventions, a door 234 (FIG. 11) includes a glass unit having a forward glass pane 236, a rearward glass pane 238 and preferably an intermediate pane 240. One or more of the panes may be coated with a reflective coating for reflecting infrared radiation. The spacing 242 between glass panes can be filled with an inert gas such as Argon, and the spacing can be maintained by suitable spacers 244, which may be conventional spacers, such as the "comfort seal" manufactured by TruSeal Technologies, Inc., and other spacing and sealing configurations. Conventional sealant may be placed about the spacers to a level flush with the outward facing perimeter edges of the glass panes, or even over those surfaces if desired. The spacers 244 can also be cold rolled steel, which would have better thermal characteristics than aluminum. The forward glass pane 236 includes a forward facing surface 246 and a rearward facing surface 248. The rearward glass pane includes a rearward facing surface 250 and a forward facing surface 252. The glass unit is preferably surrounded about its peripheral edge portion by a conventional glazing channel 254 for protecting and helping to reliably hold the glass unit. The glazing channel 254 preferably includes forward and rearward side walls extending over the respective surfaces of the glass unit approximately the same distance as the door rail extends over the same surfaces. The glazing channel may be omitted, or a tape may be substituted extending the length of each door rail against the forward facing surface 246 of the forward glass pane. The tape can be about one half inch wide more or less and about 0.060 inch thick, more or less, and both sides of the tape may include adhesive or other material to help seal or hold the glass to the frame rail. The tape may be a foam or other polymeric tape, and may be, for example, a film supported polyolefin film tape or similar material. The three pane glass pack can be about one inch or more in overall thickness, but it can also be less, depending on design preference.

In one preferred embodiment, a glass unit 398 for use in a door such as 234 for a refrigerated display case having improved insulating characteristics would include a forward glass pane 236 with a low emissivity coating 400 on the inside or rearward-facing surface 248 and a rearward glass pane 238 with its own low emissivity coating 402 on the inside or forward facing surface 252. The coatings may be pyrolytic tin oxide with an emissivity of 0.20 or less, applied to produce a configuration of between 15 and 20 ohms per square foot. The intermediate pane 240 would preferably be included in the glass unit for improved thermal insulating properties, and may be though typically would not be coated. The space between the glass panes would preferably be filled with an inert gas such as Argon or other suitable gas, such as a non-reactive gas, inert gas or the like. The edges of the glass panes are kept spaced apart and sealed, in the preferred embodiment, by Comfort Seal spacers or other "warm edge" technology spacers, having little or no material such as metal that is relatively thermally conductive.

In one form of the spacer, the spacer between each pair of adjacent glass panes would take the form of a rectilinear spacer assembly, extending around the peripheral edge portions of each glass pane facing its adjacent glass pane. An appropriate sealant such as hot melt butyl can be applied at corners of the spacer to seal any openings created when corners are formed in the lengths of the spacer, and at the junctions where opposite ends of the spacers are brought together to form a closed spacer assembly. Each length of the spacer assembly would preferably include an interior body portion 406 formed of a desiccant matrix extending the width of the spacing between adjacent glass panes. An outer-most edge of the interior body portion 406 is adjacent on each side thereof polyisobutylene sealant beads 408 contacting each adjacent glass pane to form a seal with the glass pane. The height of each bead into the spacer from the adjacent glass pane may be between 10 and 20 percent of the spacing distance between adjacent glass panes.

The interior space between adjacent glass panes and their respective beads 408 and exterior to the inner body portion 406 preferably includes a vapor barrier film 410, which may take the form of a metal, Mylar or other vapor-impervious film extending the width of the spacer between adjacent glass panes. The film may be supported at each end by the beads 408. A hot melt sealant 412 surrounds the beads, the film and the outwardly facing portion of the body portion 406 to form a seal between the adjacent glass panes. The hot melt extends from the body portion 406 to the outer peripheral edges of the glass panes. The hot melt preferably surrounds a polymeric core 414 centered in the hot melt between the adjacent glass panes. The core preferably takes up about 60–80 percent of the width-wise spacing between adjacent glass panes, with the hot melt separating the core from each of the adjacent glass panes. The core preferably extends from the plane of the outer peripheral edges of the glass panes approximately two-thirds of the way into the hot melt. The core is preferably formed from a relatively firm thermoplastic or thermosetting material, and may be formed from EPDM or other suitable material. The core can also be completely surrounded by the hot melt 20. Such a warm edge technology spacer and seal can be used between each of the adjacent glass panes. Alternatively, such a spacer can be used between the forward glass pane and the intermediate pane, or between the intermediate pane and the rearward glass pane, with a different type of spacer between the other panes.

Figure 11:
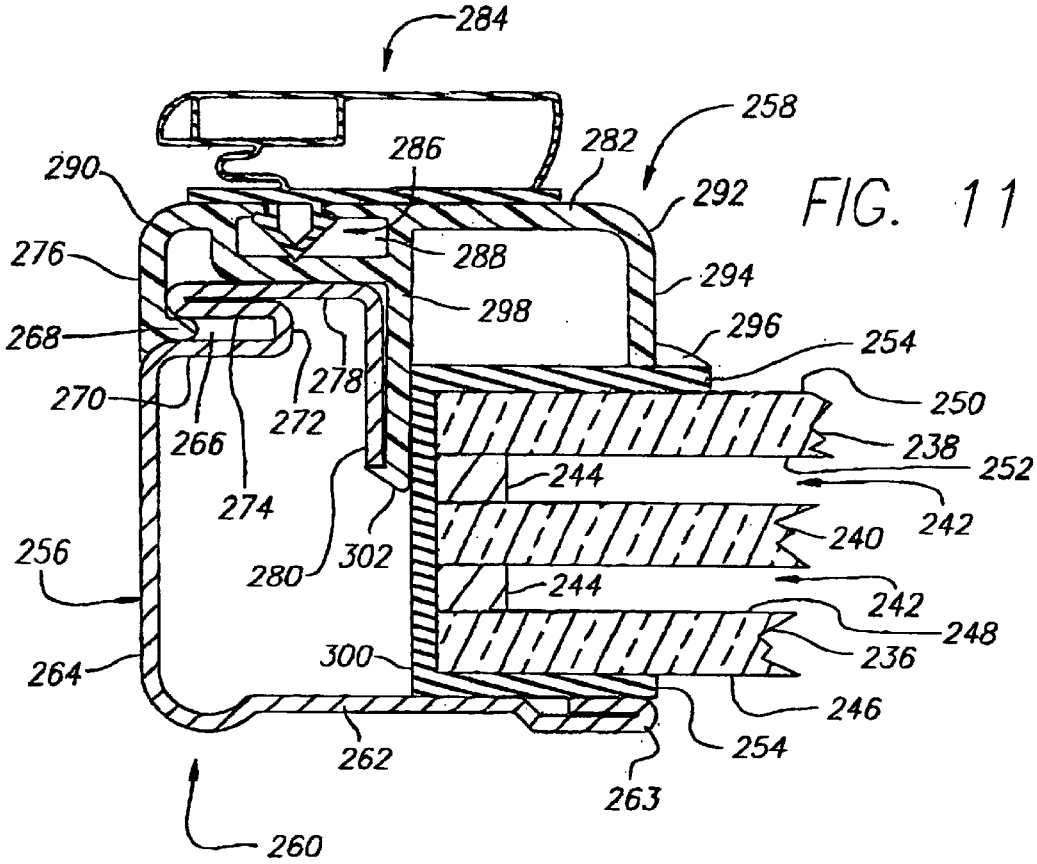
FIG. 11 is a detailed cross-section and partial cutaway view of one embodiment of a door frame around a glass unit in accordance with one aspect of one of the present inventions.
Figure 11A:
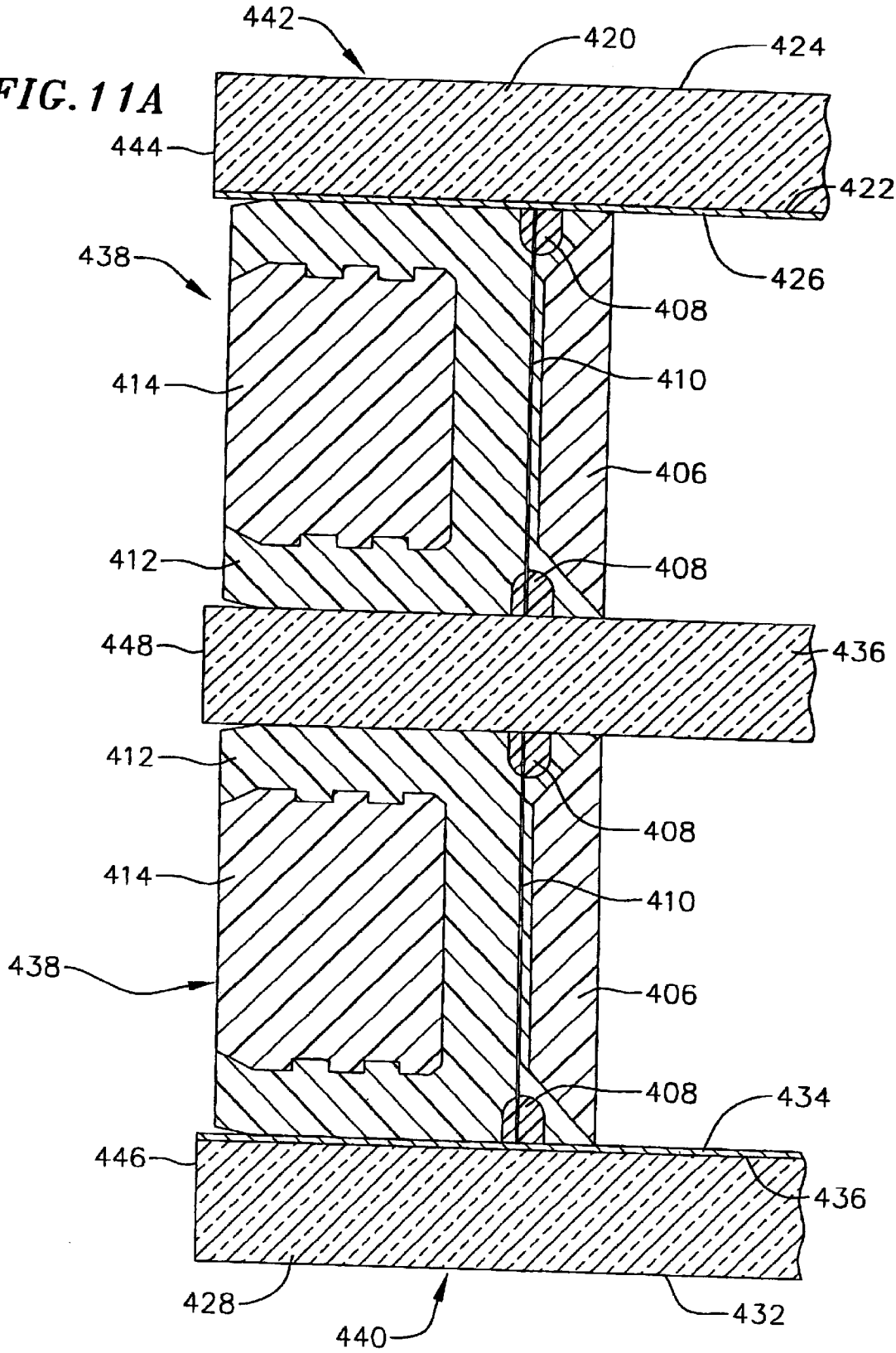
FIG. 11A is a partial cross section of a peripheral edge portion of a glass unit for use in a swing door for a refrigerated display case.

A glass unit (FIG. 11A) in accordance with one aspect of the present inventions may be formed by assembling a first glass panel 420 having an inside surface 422, an outside surface 424 and a low emissivity coating 426 on the inside surface. The low emissivity coating preferably has an emissivity of 0.20 or less, and may be formed from pyrolytic tin oxide or some other suitable material and/or some other deposition process, for example vacuum deposition coating. The glass unit also preferably has a second glass panel 428 having an inside surface 430 and an outside surface 432 and a low emissivity coating 434 on the inside surface 430. In the preferred embodiment where the glass unit is intended to have an enhanced thermal insulating characteristics, a third, intermediate glass panel 436 is included between the first and second glass panels. One or more of the glass panes can also have an electro-conductive coating on the surface of the pane for generating heat, such as for those environments where humidity is especially high. For example, the forward or the rearward glass panes, or both, could be heated. The coating would typically be placed on an interior surface of the glass pane, so that users of the display case could not come into contact with the coating. The coating could be incorporated into and made part of the low emissivity coating on a given surface of a glass pane, where the surface is intended to be heated for part or all of the time, as well as reflective. Bus bars coupled to an energy source would supply energy to the electro-conductive coating for heating the glass surface.

The adjacent glass panels are separated and held in a spaced apart configuration by preferably identical spacer assemblies 438 extending around perimeter portions 440 and 442 of the glass unit, preferably slightly in board from the exposed edges 444, 446 and 448 of the first, second and intermediate glass panels, respectively. Where the spacer assemblies are not identical, at least one of the spacer assemblies is preferably formed from a warm edge spacer assembly.

At least one of the spacer assemblies is formed from a polymeric material embedded with a desiccant. In one preferred embodiment, the polymeric material may be hot butyl for a similar compound embedded with a suitable desiccant. The polymeric material is preferably positioned on the inside of the spacer adjacent the open space between the glass panes and extends substantially the entire width between adjacent glass panes separated by the spacer. The interior body portion 406 can be shaped so as to set into hot melt butyl 412 extending across the width of the spacing between the adjacent glass panes and inside the metal foil 410.

The hot melt butyl 412 extends from the metal foil 410 substantially to the outer most portion of the spacer assembly, and surrounds the polymeric core 414. In this configuration, sealant extends on both the inside and the outside surfaces of the metal foil 412, and width wise from the surface of one glass panel to the surface of the adjacent glass panel to seal between them. The sealant beads 408 help to seal between the metal foil and the adjacent surfaces of the glass panes and contribute to reducing vapor flow between the inside and the outside of the glass unit. In the preferred embodiment, there is little or no structural metal in the spacer assembly. An any given cross-section of the spacer, there are at least two in preferably at least three different materials forming the spacer, including the desiccant-embedded sealant material 406. Plain hot melt butyl can also be included in the spacer to help seal between the adjacent glass panes. An additional material or materials can also be included, such as in the form of the vapor barrier film 410 and/or the sealant beads 408. The core 414 can also be included to provide resistance to compression of the spacer due to any external forces.

Another example of a warm edge technology spacer is a spacer such as that shown and described in U.S. Pat. No. 5,851,609, incorporated herein by reference, and describing what is commonly known as a Swiggle® spacer, by TruSeal Technologies. However, in the embodiments described herein for a door, such as a display case door that may be used for a refrigerated display case, the spacer element forming the undulating portion preferably has a wave or peak amplitude, or spacing from the trough of one part to the peak of the adjacent portion of the undulation, greater than approximately 0.100 inch, and preferably in the range of 0.100 to 0.125 inch or more, to withstand the compressive forces that may develop in a swing door under normal operating conditions, for example from opening and closing, racking or twisting as a result of the door size and movement during normal operation and from the application of the door frame itself about the edges of the glass unit. One preferred amplitude may be in the range of about 0.125–0.200 inch with a possible thickness of about 0.160 to 0.170 inch. Alternatively or additionally, the wall thickness of the metal or other material of the spacer element can be made thicker to further withstand the compressive forces in the glass unit, even though doing so would increase the cross sectional area for thermal flow from one glass pane to the adjacent glass pane, thereby tending to decrease the insulating properties of the glass unit. However, the integrity of the glass unit within the door frame would be enhanced.

In a triple pane configuration for a refrigerated display case, the overall thickness of the glass pack may be 1 and ¼ inch or more, with ⅛ inch glass and two 7/16 inch air spaces. Alternatively, the glass unit can be made up of two glass panes each with interior surfaces coated with a low emissivity coating and separated by warm edge technology spacers.

The glass unit is then assembled into a door with suitable surrounding door frames, as described more fully herein. The glass unit can provide significant thermal insulating qualities sufficient to reduce or entirely eliminate any need for heated glass and/or heated frames in the door for preventing moisture condensation. Environments having lower relative humidity may be well-suited for doors, both freezer and refrigerator doors, containing such glass units having the improved thermal insulating qualities.

The door frame 234 is preferably formed from a cold rolled steel frame element 256 with a plastic or other thermally insulating member 258, both extending longitudinally the length of a given side of the door. Four linear portions would then be combined to form a substantially rectangular door frame, or one length punched or cut to allow bending at corners and forming into a rectangular frame with joinder of opposite ends to support the glass unit. The insulating member 258 is preferably interposed between the cold area of the display case and the frame element 256 to insulate the frame element 256 from the cold. In one preferred embodiment, the frame element includes a forward portion 260 having a first wall 262 extending inwardly in a direction toward the center of the door from a peripheral side wall 264 toward and preferably to a point overlying part of the forward surface 246 of the forward glass pane 236. The inward end of the first wall 262 can be rolled rearwardly and turned back toward the outside to produce a fold or hem 263 to conceal the edge of the metal. The first wall 262 can be formed or otherwise configured to present a pleasing appearance, such as by paint, texture, shape or otherwise. The dimensions of the first wall 262 are preferably such as to reliably hold, retain and protect the glass unit. The dimensions can be selected to achieve the desired purpose of the intended design.

The side wall 264 preferably extends rearwardly from the front first wall 262 preferably straight back to a groove 266. In the preferred embodiment, the groove opens peripherally, and specifically laterally outward, relative to the door. The groove 266 receives and holds an engagement ridge or anchor portion 268 on the outer side of the insulating member 258 for helping to hold the insulating member in place. The groove 266 is formed by a first inwardly extending wall 270, transitioning to or terminating at a base wall 272. The other side of the groove is formed by a rearward wall 274 extending outwardly substantially parallel to the wall 270 and terminating at a point inward of the wall 264 so that an outer wall 276 of the insulating member 258 can be flush with the wall 264. Preferably, the wall 276 is slightly thicker, such as around 0.075 inch, than the wall 264 for additional strength. The groove can extend in other directions while still satisfactorily holding and supporting the insulating member, but outward peripheral opening of the groove is preferred. Additionally, the groove can extend further from the wall 264 to provide added support strength for the corner key.

The frame element 256 preferably also includes an inwardly extending back wall 278. The back wall 278 supports and preferably holds part of the insulating member 258. The back wall 278 terminates in and supports a forwardly extending inner side wall 280 extending between one-quarter and one-half the distance between the back wall 278 and the first wall 262. The remainder of the distance between the back wall 278 and the first wall 262 is open toward the glass unit.

The walls 274 and 278 provide strength to the assembly, and the wall 270 helps to reliably hold a corner key, described more fully below, in place. The side wall 280 also supports the corner key and may include openings for receiving fasteners threaded or otherwise fastened to the corner key for holding the corner key in place, and thereby holding adjacent door rails in place. This arrangement for the corner key fasteners may allow hidden placement of the corner key fasteners, for the assembled door frame, before the glass unit is dropped into place. Alternatively, the corner keys may be held in place by suitable fasteners extending through the walls 256, and/or less desirably walls 262 considering these walls are more visible. Alternatively, or in addition, fasteners may be extended through one or more of walls 278, or 270 and 274.

The frame is formed from cold rolled steel using steps similar to those used to form the perimeter frame rail elements by cutting and creating the mounting openings and other attachment openings as desired. The door rails can then be rolled to the desired shape and cross sectional configuration, without regard to the locations of the openings and other accommodations for attaching hardware and for connecting adjacent door frame elements together.

The insulating member 258 is preferably a relatively rigid plastic element, such as rigid PVC similar or identical to the other rigid plastics used in the refrigerated display cases. It includes a rearward facing wall 282 for forming a first barrier to the passage of cold air to the frame element 256. The wall 282 also supports the sealing gasket 284 for forming the seal between the doors and the surrounding frame. The gasket 284 includes a suitable attachment element 286 for engaging the door, preferably through a gasket groove 288 formed in the wall 282 near the outer peripheral edge of the wall 282. Alternatively, the gasket can be supported by the wall 282 through an adhesive, or other engagement surfaces. The gasket can also be supported by one or more fasteners, for example, holding the base of the gasket against the adjacent wall 282 at a convenient point, such as between walls 294 and 298, described below. The base 284A of the gasket could be rigid or semi-rigid and the rearward-facing portion of the fastener could be hidden from view by the flexible gasket wall portion 284B.

The wall 282 terminates at its outer edge 290 joining the wall 276. The wall 282 terminates at its inner edge 292 at a forwardly extending barrier wall 294, for limiting the passage of cold air to the frame element 256. The barrier wall 294 terminates at a soft plastic or dual durometer, co-extruded tip 296 for forming a seal against either the glazing channel 254 or the rearward surface 250 of the rearward glass pane 238, to further limit any thermal transfer between the cold area of the case and the ambient or warm side of the door. The tip is preferably about 78 Shore A vinyl, and is pressed against the rearward surface 250 of the glass pane 238 by sizing the length of the barrier wall about $1/16^{th}$ inch greater than necessary to reach the glass unit. The extra length allows the insulating member to be biased against the glass unit to ensure a suitable seal and to limit the thermal transfer between the cold area of the case and the metal frame 256. The bias will also help to press the glass against the tape on the opposite side of the door frame rail. Alternatively, the tip can be of a similar material and hardness as the rest of the insulating member.

The insulating member 258 also includes an engagement wall 298 extending between the inner side wall 280 and the base 300 of the glazing channel (or sealant when the glazing channel is omitted) to engage the end of the inner side wall 280 and holding insulating member 258 on the frame rail 256. The engagement wall 298 includes a hook, barb or other engagement element 302 to fit over or otherwise engage the end of the inner side wall 280. The dimensions of the assembled door frame and the assembled glass pack are preferably such as to allow relatively smooth insertion of the engagement wall 298 while still reliably supporting the glass pack in the frame. In one preferred form, there is allowed about a three-sixteenths inch gap or clearance between the glass and the wall 280.

Setting blocks (not shown) may be placed along the top and bottom peripheral edges of the glass units to maintain the desired spacing between the edges of the glass unit and wall 280 of the door rail, or other support surface. The setting blocks are put along the top and bottom portions of the door to help support the weight of the glass panes. They are preferably placed along both top and bottom in case the door is configured to be reversible. Gaps are preferably formed in the engagement wall 298 to accommodate the setting blocks.

Openings or voids in the door frame rail and/or in the insulating member 258 insulate and inhibit thermal transfer between the cold and warm portions of the door. One or more of the voids can also be filled or coated with insulating material, for example a low density industrial PVC foam, to improve or modify the thermal insulating characteristics of the voids. For example, the spacing between the plastic insulating member 258 and the glass or glazing channel may include or be filled with insulation, such as a foam tape. The foam insulation may be configured to be in a free, uncompressed state or in a partly compressed state. For example, a foam insulation between the insulating material and the glass may be inserted between the glass and the wall 282, in the embodiment shown in FIG. 11, and partly compressed when the insulating member is installed, and the barb 302 engages the wall 280. Similar comments apply to the other voids in the insulating member and other parts of the door, and to other configurations of the door and insulating member.

Figure 12:
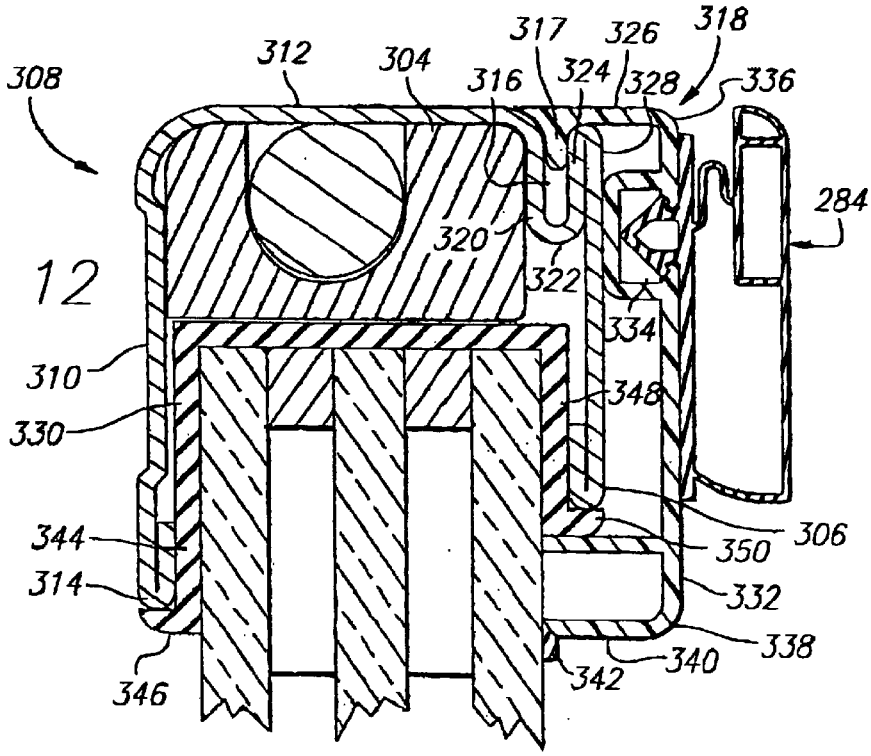
FIG. 12 is a detailed cross-section and partial cutaway view of one embodiment of a door frame around a glass unit in accordance with another aspect of one of the present inventions.

Four door rail elements can be assembled into a four-sided door frame assembly using corner keys, such as the corner key 304 shown in FIG. 12, configured as would be apparent to one skilled in the art of mitered commercial refrigerated doors. In the embodiment shown in FIG. 11, the door is assembled as a drop-in unit, with the four door rail elements being fastened together with corner keys into a rectangular door frame assembly. The door rails and the corner keys are fastened together with appropriate fasteners. The glass unit with an appropriate glazing channel 254 is then dropped down into the upwardly-facing, rearward portion of the door frame assembly. The insulating element 258 is then snapped or latched into place to hold the glass unit against the first wall 262, by first engaging the anchor portion 268 into the groove 266 and then the engagement portion 302 over the end of the wall 280. The insulating members 258 can then be sealed, glued or otherwise joined together.

The doubled-sided adhesive of sealing tape may be used in addition to or in place of the glazing channel 254. Before the glass unit is dropped into the assembled frame, and possibly before the frame elements are assembled into a rectangular frame, the tape may be placed against the rearward-facing surface of the wall 262. The tape is preferably placed adjacent the rounded end 263 and extends about ½ inch in the direction of the edge of the forward glass pane.

In a further embodiment of a door frame in accordance with one or more aspects of the present inventions (FIG. 11B), a door assembly is formed with a door frame 234B and a glass unit such as 235B, having features similar to those described with respect to FIG. 11 carrying the same reference numerals. The glass unit has a forward glass pane 236B, a rearward glass pane 238B and preferably, though not necessarily, an intermediate pane 240B. As with the embodiment shown in FIG. 11, one or more of the panes may be coated with a reflective coating for reflecting infrared radiation and/or an electro-conductive coating for heating the respective glass pane. The spacing 242B between the glass panes can be filled with an inert gas such as Argon, Krypton, or other suitable gas. The spacing can be maintained by spacers 244B, and sealant may be placed about the spacers to a level flush with the outwardly facing perimeter edges of the glass panes, or even over the edges if desired. The forward glass pane 236B includes a forward-facing surface 246B and a rearward-facing surface 248B, and the rearward glass pane 238B includes a rearward-facing surface 250B and a forward facing surface 252B. In the configuration shown in FIG. 11B, a glazing channel is omitted and an insulating or foam tape 255B is adhered to the forward portion 262B of the frame 234B and to the forward surface 246B of the forward glass pane.

The door frame 234B is preferably formed from extruded aluminum or other suitable material or other suitable forming process, and includes a removable insulating member 258B extending longitudinally the length of a given side of the door. The frame includes a forward portion 260B having a first wall 262B extending inwardly toward a center of the glass unit, over a surface of the forward glass pane and over the insulating material 255B so that the wall overlies part of the forward surface 246B of the forward glass pane 236B. The first wall 262B can be formed, shaped or configured in any number of ways to achieve the desired appearance, function or characteristic.

A side wall 264B extends rearwardly from the front first wall 262B preferably straight back to a groove 266B formed in or on an extension wall adjacent a rearward wall portion 278B. The rearward wall portion 278B extends inwardly toward the glass unit and rearward of the forward portion. In the preferred embodiment, the groove opens peripherally, and specifically laterally outward, relative to the door, and receives, engages or holds an engagement ridge or anchor portion 268B on the insulating member 258B for helping to hold the insulating member in place on the door frame. The groove is preferably formed as an attachment or extension on the wall 278B, extending rearward from the rearward surface of the wall 278B, or may be formed within the thickness defined by the rearward and forward surfaces of the wall 278B.

The rearward wall 278B preferably terminates in and supports a forwardly extending inner side wall 280B extending between the rearward wall 278B and the forward wall 262B. A complementary rearward extending wall 281B extends from the forward wall 262B toward the inner side wall 280B. The walls 280B and 281B provide strength to the door frame. The walls also help to securely hold corner keys 283B used to join adjacent frame elements, which in turn may support hinge elements in a hinge pocket 285B. Fasteners may be used to join an end of a frame element to the portion of the corner key retained within the cavity between the forward wall 262B, the side wall 264B, the rearward wall 278B, and the walls 280B and 281B. For example, fasteners may be applied through walls 280B and/or 281B into the adjacent legs of the corner key.

In the preferred embodiment, the rearward wall 278B is reduced in width relative to the overall width of the frame, the overall width of the frame being the dimension between the side wall 264B and the inner most edge of the frame, such as the tip of the forward wall 262B adjacent to forward glass pane 236B. The reduced size of the rearward wall 278B reduces the possibility of thermal transfer between the cold compartment of the display case and the metal portion of the frame. Additionally, the relative size of the insulating portion 258B extending from the wall 276B to the wall 294B also helps to reduce thermal transfer to the metal portions of the frame. In the preferred embodiment, no portion of the rearward wall extends over or even contacts the rearward glass pane 238B.

Figure 11B:
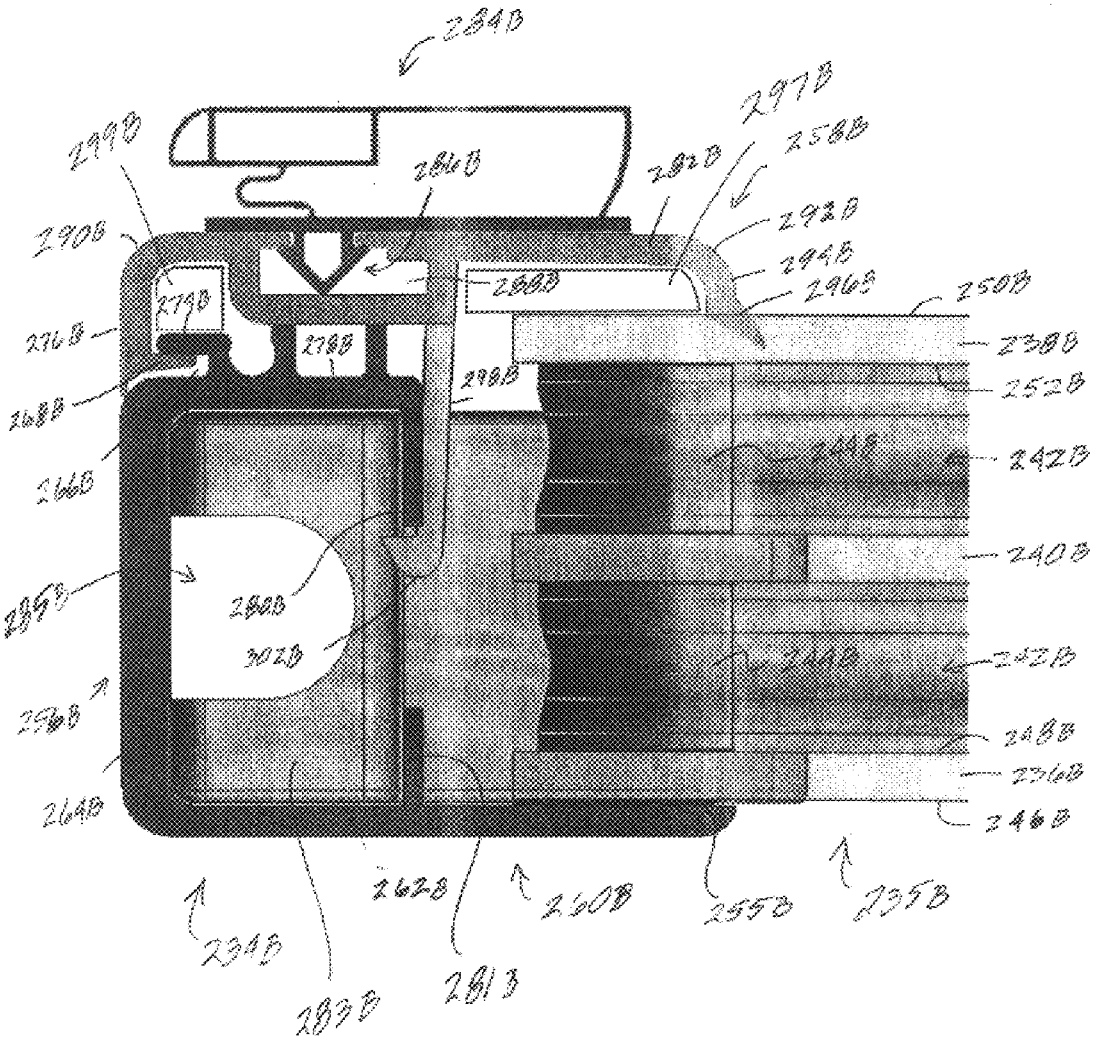
FIG. 11B is a detailed cross-section and partial cutaway view of another embodiment of a door frame around a glass unit in accordance with one aspect of one of the present inventions.

The insulating member 258B is preferably a relatively rigid plastic element, such as rigid PVC. It includes a rearward facing wall 282B for forming a first barrier to the passage of cold air to the frame element 256B. The wall 282B also supports the sealing gasket 284B and the attachment element 286B for engaging the gasket groove 288B. The wall 282B extends to an outer edge 290B joining the wall 276B. The wall 282B also extends inwardly to an edge 292B, which turns forwardly and inwardly to a barrier wall 294B, for limiting the passage of cold air to the frame element 256B. The barrier wall 294B terminates at a tip 296B for forming a seal against the rearwardfacing surface 250B of the rearward glass pane 238B. The tip 296B helps to limit thermal transfer between the cold area of the display case to the frame and the warm side of the door. The tip 296B is formed in its free state to extend as shown in FIG. 11B, but extends along the face of the surface 250B when the glass unit is in place and the insulating member is attached to the frame. The wall 282B of the insulating member 258B is preferably spaced from the metal portion of the frame 234B so as to more completely insulate the metal portion of the frame from the cold area of the display case. The greater the spacing, the more thermal insulation is created or may be inserted between the wall 282B and the frame wall 278B. Insulation may be inserted, for example at 297B and 299B, and may take any of the forms of insulation discussed herein.

The insulating member 258B also includes an engagement wall 298B extending between the inner wall 280B and the glass unit to engage the wall 280B and holding the insulating member 258B on the rail 256B. The engagement wall 298B includes a hook, barb or other engagement element 302B to fit over or otherwise engage the end of the wall 280B.

In an alternative embodiment of a door rail profile, as shown in FIG. 12, the metal door rail may include a rearward wall 306 extending inwardly over a portion of the glazing channel 254 so that the door rail assembly forms a pound-on unit. The rearward portion of the door rail may include an outwardly extending groove such as 266 described with respect to FIG. 11 to receive and hold an insulating member, or it may include a rearward extending groove for receiving and engaging an insulating member. In the preferred embodiment, the insulating member extends inwardly over and covers the rearward wall 306 to reduce any heat transfer between the cold area and the warmer portion of the door rail. In the preferred embodiment, the wall 306 extends over the glass unit a distance shorter than the distance that the first wall 262 extends over the forward glass pane. This allows the insulating member to extend over and cover the inner portion of the wall 306.

A frame element includes a forward portion 308 having a first wall 310 extending inwardly in a direction toward the center of the door from a peripheral side wall 312 forward of and preferably to a point overlying part of the forward surface 246 of the forward glass pane 236. The inward end of the first wall 310 can be rolled rearwardly and turned back toward the outside to produce a fold or hem 314 to conceal the edge of the metal. The first wall 310 can be formed or otherwise configured to present a pleasing appearance, as previously described. The dimensions of the first wall 310 are preferably such as to reliably hold, retain and protect the glass unit. The dimensions can be selected to achieve the desired purpose of the intended design.

The side wall 312 preferably extends rearwardly from the front first wall 310 preferably straight back to a groove 316. The groove 316 preferably accepts and retains a holding ridge 317 of an insulating member 318. The groove 316 extends parallel to the glass panes so as to more securely support and hold the insulating member 318. The groove 316 is formed by a first inwardly extending wall 320, transitioning to or terminating at a base wall 322. The other side of the groove is formed by a rearward wall 324 extending outwardly substantially parallel to the wall 320 and terminating at a point preferably inward of the wall 312 so that an outer wall 326 of the insulating member 318 can be flush with the wall 312. Preferably the wall 326 is slightly thicker than the wall 312 for additional strength. The groove can extend in other directions and can extend further from the wall 312 to provide added support strength for the corner key 304.

The frame element preferably also includes an inwardly extending back wall 328. The back wall 328 supports and preferably holds part of the insulating member 318. The back wall 328 terminates in an outwardly-folded back end 306 for sandwiching a glazing channel 330 and the edge portions of the glass unit.

The walls 320, 324 and 328 provide strength to the assembly, and the wall 316 helps to reliably hold a corner key in place. The corner key can be held in place with suitable fasteners through one or more walls of the door rail elements. The frame is preferably formed in a manner similar to that described above with respect to the frame of FIG. 11.

The insulating member 318 is preferably a relatively rigid plastic element, such as rigid PVC similar or identical to the other rigid plastics used in the refrigerated a display cases. The insulating member 318 includes a rearward facing wall 332 for forming a first barrier to the passage of cold air to the frame element. The wall 332 also supports the sealing gasket 284 for forming the seal between the doors and a surrounding frame. The insulating element includes a gasket groove 334, but the gasket can be supported by the wall 332 by adhesive, fasteners or other engagement surfaces or engagement means.

The wall 332 terminates at its outer edge 336 joining the wall 326. The wall 332 terminates at its inner edge 338 at a forwardly extending barrier wall 340, for limiting the passage of cold air to the frame element. The barrier wall 340 terminates at a soft plastic or dual durometer, co-extruded tip 342 for forming a seal against the rearward surface 250 of the rearward glass pane 238, to farther limit any thermal transfer between the cold area of the case in the ambient or warm side of the door. The tip is preferably similar or identical to the tip 296 described above. It is also preferably pressed against the rearward surface 250 of the glass pane to form a desired seal.

The glazing channel 330 preferably includes a front wall 344 terminating in the forwardly extending protective lip 346 for covering the rolled-back end 314. The glazing channel 330 preferably also includes a rear wall 348 extending a distance inwardly over the rearward-facing surface of the rearward glass pane a distance less than the distance the front wall 344 extends over the forward glass pane. The rear wall 348 also terminates at a rearward extending protective lip 350 for covering the rollback end 306 of the wall 328. Alternatively, the wall 348 can extend inwardly L further and may include a rearward extending lip for engaging or contacting the end of the wall 340.

Figure 21:
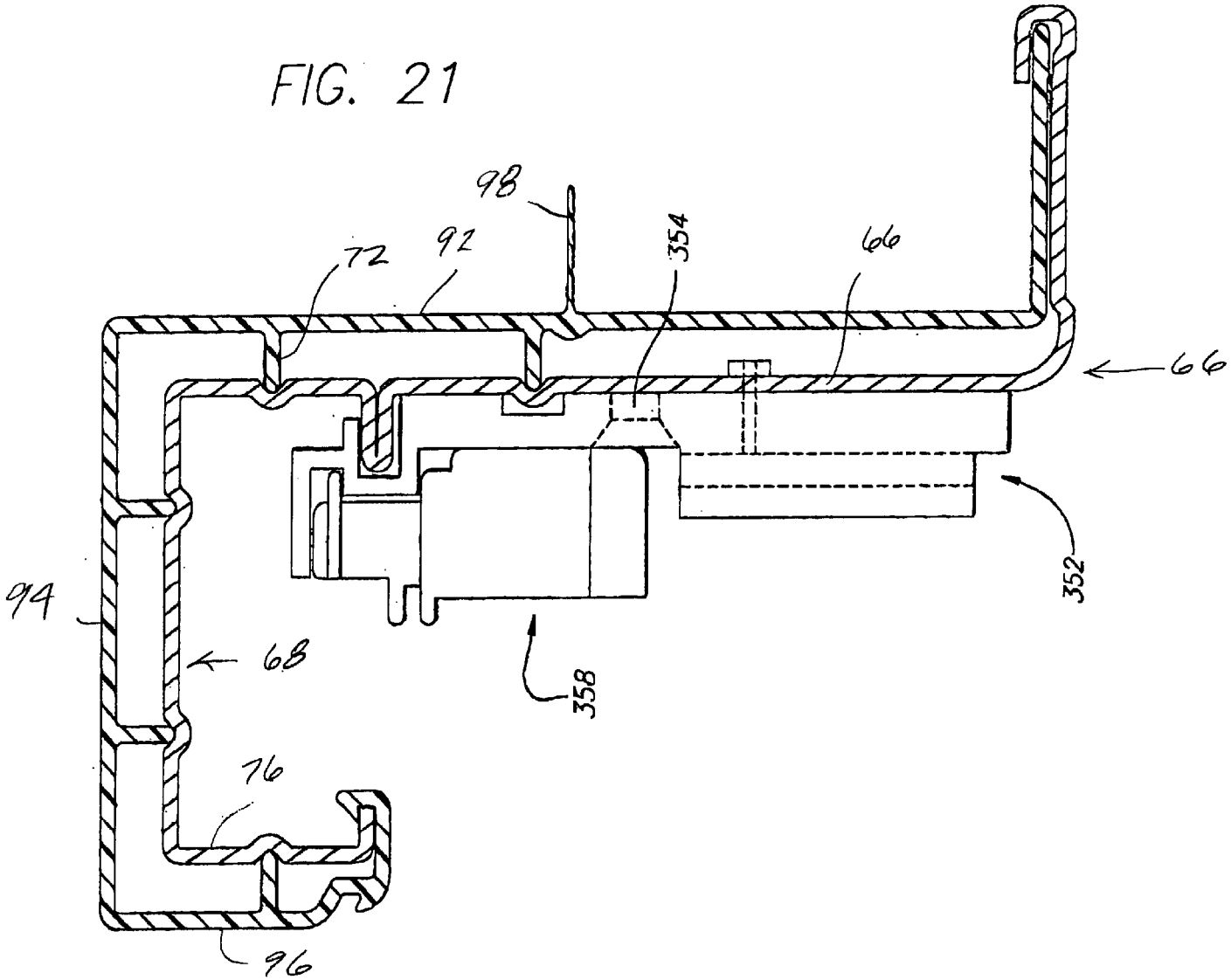
FIG. 21 is a side elevation view of a frame element assembly and hingepin socket.

In FIG. 21, an alternative form of gib 352 is shown mounted to a parameter door frame element through fastener holes 354. A backing or support plate may be included as desired for helping to support to gib on the frame. The forward part of the gib for receiving the hinge pin may be substantially similar to that described above, but may also includes one and preferably two or more registration pins or bosses 356 for engaging complementary holes into frame. The pins 356 minimize rotational movement or twisting of the gib during opening and closing of the door. The gib may also support an electrical socket 358 for a combination hinge pin electrical connector.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A frame for an opening in a refrigerated display case for receiving and supporting one or more doors for allowing access into the case, the frame comprising:

a first wall extending rearwardly from a forward portion of the opening wherein the first wall is formed from steel and includes a bend in the wall, a second wall extending from the first wall in a second direction and a third wall extending from the second wall in a direction different form the second direction to define a recess between the first, second and third walls; and a contact plate supported by the bend in the first wall and extending between the first and third walls.

2. A frame as in claim 1 further comprising a frame cover and insulation between the frame cover and at least one of the first, second and third walls.

3. A frame as in claim 2 wherein the frame cover is positioned on an interior surface of the frame between an inside of the display case and an outside surface of the frame.

4. A frame as in claim 2 where the frame cover includes a plurality of standoffs.

5. A frame as in claim 4 where the first, second and third walls include a plurality of grooves and wherein at least one of the standoffs extends into one of the grooves.

6. A frame as in claim 2 wherein the frame cover includes a surface for supporting a light source.

7. A frame as in claim 2 wherein the frame cover includes a surface for supporting a lens.

8. A frame as in claim 1 further comprising a fourth wall having a lip defining a groove.

9. A frame as in claim 8 further comprising a frame cover having an edge extending into the groove.

10. A frame as in claim 8 further comprising first and second frame elements each having a lip and a bridge element extending from the lip of the first frame element to the lip of the second frame element.

11. A frame as in claim 10 wherein each of the lips in the first and second frame elements define respective grooves and the bridge element is an angle plate having a first leg extending into the groove of the first frame element and a second leg extending into the groove of the second frame element.

12. A frame as in claim 11 further comprising a corner connecting element extending into the groove for allowing a corner of one frame element to be joined to a corner of an adjacent frame element.

13. A frame as in claim 1 where the first, second and third walls form a substantially rectangular recess.

14. A frame as in claim 13 wherein the first and third walls define an opening to the recess and wherein the contact plate is a door contact plate extending across the opening.

15. A frame as in claim 13 further including a removable cover for extending from the first wall to the third wall for substantially covering the recess.

16. A frame as in claim 15 wherein the cover includes a surface for accepting the contact plate.

17. A frame as in claim 1 further including a hinge support element wherein the hinge support element is surface mounted to the frame.

18. A frame as in claim 1 further including a hinge support element wherein the hinge support element includes at least one projection extending into an opening in the frame.

19. A frame as in claim 18 wherein the at least one projection is a registration pin engaging a complimentary opening in the frame.

20. A mullion for combining with a perimeter frame for an opening in a refrigerated display case for receiving and supporting one or more doors for allowing access into the case, the mullion comprising:

at least first and second walls to define a recess between the first and second walls and formed from rolled steel and wherein at least one of the first and second walls includes at least one bend in the wall; and a contact plate extending between the first and second walls closing the recess.

21. A mullion as in claim 20 further comprising a mullion cover and insulation between the mullion cover and at least one of the first and second walls.

22. A mullion as in claim 21 wherein the mullion cover is positioned on an interior surface of the mullion between an inside of the display case and an outside surface of the mullion.

23. A mullion as in claim 21 where the mullion cover includes a plurality of standoffs.

24. A mullion as in claim 23 where the first and second walls include a plurality of grooves and wherein at least one of the standoffs extends into one of the grooves.

25. A mullion as in claim 21 wherein the mullion cover includes a surface for supporting a light source.

26. A mullion as in claim 21 wherein the mullion cover includes a surface for supporting a lens.

27. A mullion as in claim 20 where the first and second walls and a third wall form a substantially rectangular recess.

28. A mullion as in claim 20 wherein the first and third walls define an opening to the recess and wherein the mullion further comprises a door contact plate extending across the opening.

29. A mullion as in claim 20 further including a removable cover for extending from the first wall to the third wall for substantially covering the recess.

30. A mullion as in claim 29 wherein the cover includes a surface for accepting a door contact plate.

31. A door for a refrigerated display case, the door comprising:

a glass unit including a forward glass pane and a rearward glass pane for allowing viewing of product within the display case;

a door frame for surrounding and supporting the glass unit;

the door frame being formed from rolled steel and including a perimeter frame edge portion and a forward portion extending inwardly from the perimeter frame edge portion toward an edge of the forward glass pane and a first side portion extending rearwardly from the perimeter edge portion and a second wall extending inwardly from the first side portion and a third wall together defining a groove; and a plastic insulating assembly having at least one anchor portion extending into the groove.

32. A door as in claim 31 further comprising an insulating tape between the frame and the glass unit.

33. A door as in claim 31 wherein the plastic insulating assembly extends inwardly toward the glass unit and contacts the glass unit.

34. A door as in claim 31 wherein the forward portion and the second and third walls have lengths and wherein the second and third walls are shorter than the length of the forward portion and wherein the plastic assembly includes a projecting portion for projecting between the second wall and an edge of the rearward glass pane in the glass unit.

35. A door as in claim 34 wherein the frame further includes an interior wall having an end and extending between an edge of the rearward glass pane and the first side portion and wherein the projecting portion of the plastic assembly engages the end of the interior wall.

36. A door as in claim 31 further including a glazing channel encasing the forward and rearward glass panes.

37. A door as in claim 31 wherein the plastic wall portion includes an end portion extending inwardly toward the rearward glass pane.

38. A door as in claim 37 wherein the plastic wall end portion contacts the rearward glass pane.

39. A door as in claim 37 further including a glazing channel around edges of the rearward glass pane and wherein the plastic wall end portion contacts the glazing channel.

40. A door for a refrigerated display case, the door comprising:

a glass unit including a forward glass pane and a rearward glass pane for allowing viewing of product within the display case;

a door frame for surrounding and supporting the glass unit, at least one side of the door frame including a forward portion extending partly over a surface of the forward glass pane, a rearward portion extending inwardly toward the glass unit and rearward of the forward portion and a side wall extending between the forward portion and the rearward portion; and an insulating portion engaging the rearward portion and extending from the rearward portion inwardly and contacting a surface of the rearward glass pane.

41. A door as in claim 40, further comprising a wall on the forward portion of the frame extending toward the rearward portion of the door frame.

42. A door as in claim 41, further comprising a corner key having a portion extending between the wall and the frame side wall.

43. A door as in claim 40, further comprising a wall extending from the rearward portion of the frame toward the forward portion of the door frame.

44. A door as in claim 43, further comprising a corner key having a portion extending between the wall and the frame side wall.

45. A door as in claim 43, wherein the insulating portion includes an engagement element for engaging the wall on the rearward portion of the frame.

46. A door as in claim 40, wherein the rearward wall includes an extension wall forming a groove.

47. A door as in claim 40, wherein insulating portion includes an engagement portion extending into the groove.

48. A door as in claim 40, wherein the insulating portion includes a first plastic portion and a second plastic portion having a hardness less than a hardness of the first plastic portion and wherein the second plastic portion contacts the rearward glass pane.

49. A door as in claim 40, wherein the rearward portion is spaced from and does not overlap any portion of the rearward glass pane.

50. A door as in claim 40, wherein the insulating portion and the forward portion of the frame extend over the glass unit approximately the same amount.

* * * * *